US006796142B2

(12) United States Patent
Burn

(10) Patent No.: US 6,796,142 B2
(45) Date of Patent: Sep. 28, 2004

(54) CONTINUOUS THROUGHPUT BLAST FREEZER

(75) Inventor: Mark Burn, Port Townsend, WA (US)

(73) Assignee: Integrated Marine Systems, Inc., Port Townsend, WA (US)

( * ) Notice: Subject to any disclaimer, the term of this patent is extended or adjusted under 35 U.S.C. 154(b) by 108 days.

(21) Appl. No.: 10/229,776

(22) Filed: Aug. 27, 2002

(65) Prior Publication Data

US 2003/0041614 A1 Mar. 6, 2003

Related U.S. Application Data

(60) Provisional application No. 60/316,584, filed on Aug. 30, 2001.

(51) Int. Cl.[7] ..... F25D 25/04; F25D 17/06

(52) U.S. Cl. ..... 62/380; 62/419

(58) Field of Search ..... 62/60, 62, 63, 62/65, 371, 374, 378, 380, 419, 440, 441, 451, 515

(56) References Cited

U.S. PATENT DOCUMENTS

| | | | | |
|---|---|---|---|---|
| 3,696,631 A | | 10/1972 | Valdes | 62/375 |
| 3,722,230 A | | 3/1973 | Scott et al. | 62/512 |
| 3,834,725 A | * | 9/1974 | Luoni | 280/79.2 |
| 4,107,943 A | | 8/1978 | Ohling | 62/320 |
| 4,164,129 A | | 8/1979 | Stueber | 62/381 |
| 4,171,625 A | | 10/1979 | Morgan | 62/380 |
| 4,270,598 A | | 6/1981 | Britton | 62/240 |
| 4,700,547 A | | 10/1987 | Hayashi | 62/65 |
| 4,934,151 A | | 6/1990 | Shima | 62/373 |
| 5,156,512 A | | 10/1992 | Suzuki et al. | 414/142.1 |
| 5,176,202 A | | 1/1993 | Richard | 62/63 |
| 5,205,128 A | | 4/1993 | Richard | 62/63 |
| 5,452,588 A | | 9/1995 | Onodera | 62/381 |
| 5,540,141 A | * | 7/1996 | Grubzak | 99/450.4 |
| 5,598,713 A | | 2/1997 | Bartilucci | 62/78 |
| 5,761,913 A | | 6/1998 | Liberman et al. | 62/64 |
| 6,009,719 A | | 1/2000 | Ochs | 62/380 |
| 6,105,818 A | | 8/2000 | Speranza | 221/1 |
| 6,220,338 B1 | | 4/2001 | Grandi | 165/48.1 |
| 6,233,966 B1 | | 5/2001 | Delpuech et al. | 62/374 |
| 6,235,332 B1 | | 5/2001 | Arnason | 62/374 |

FOREIGN PATENT DOCUMENTS

| | | |
|---|---|---|
| EP | 1 014 018 A2 | 6/2000 |
| EP | 1 043 555 A1 | 10/2000 |

OTHER PUBLICATIONS

Written Opinion, PCT/US02/27308, dated Aug. 5, 2003.
Brochure, Advanced Food Processing Equipment, Drag–Thru Tunnel Freezer Brochure, 1 page, (date unknown).

(List continued on next page.)

*Primary Examiner*—Denise L. Esquivel
*Assistant Examiner*—Malik N. Drake
(74) *Attorney, Agent, or Firm*—McDonnell Boehnen Hulbert & Berghoff

(57) ABSTRACT

A high capacity, continuous production blast freezer includes an insulated enclosure and a plurality of adjustable product-carrying trolleys, individually moveable with the enclosure from an entrance location to an exit location. A heat exchanger in the form of an evaporator is provided in the enclosure. The mechanical equipment for the refrigeration system can be placed within the enclosure and separated from the freezing cell by a bulkhead. In one embodiment the enclosure is in the form of a container adapted to be transportable by ship, rail or truck. The arrangement of the heat exchanger or evaporator relative to the product carrying devices and the enclosure is designed to maximize the capacity of the heat exchanger and minimize frost formation, while providing for a maximum amount of product space within the enclosure to maximize throughput of the system.

73 Claims, 23 Drawing Sheets

OTHER PUBLICATIONS

Brochure, Advanced Equipment Ltd., Site Built Spiral Freezer, 1 page, (date unknown).

Brochure, Seattle Refrigeration, Batch Blast Freezers brochure, 4 pages, (date unknown).

Bilinski, et al., "Treatments Affecting the Degradation of Lipids in Frozen Pacific Herring . . . ", Canadian Inst. Of Food Science Technology Journal, vol. 14, pp. 123–127, Apr. 1981.

University of Guelph, "Theoretical Aspects of the Freezing Process", pp. 1–5, (Feb., 2001).

Brochure, Frigoscandia Equipment AB, Spiral Freezers, FMC FoodTech, 1 page, (date unknown).

Industrial Refrigeration Handbook, "Evaporators—Air Coils and Liquid Chillers", Chap. 6, pp. 169–172 and 223 (date unknown).

Brochure, IceBits' Blast Freezer, 6 pages, (date unknown).

Brochure, Spiral 2000 The Space Saving Freezer, 3 pages (date unknown).

Dole, Frame and Freezer Plate Assembly drawing, 1 page, (date unknown).

PCT International Search Report, PCT US02/27308, dated Feb. 26, 2003.

* cited by examiner

UNDERMOUNT

CONTINUOUS THROUGHPUT BLAST FREEZER

CROSS-REFERENCE TO RELATED APPLICATION

This application claims priority to U.S. provisional patent application Ser. No. 60/316,584 filed Aug. 30, 2001, the content of which is incorporated by reference herein.

BACKGROUND OF THE INVENTION

A. Field of the Invention

This invention relates generally to industrial and commercial freezing systems for comestibles such as meat, seafood, vegetables and baked products. In particular, the invention relates to a blast freezer system designed for continuous production and which achieves a high throughput of product with a minimum of labor. The freezer system can be either fixed or portable. Some embodiments described below are particularly suited for installation on fishing boats or in remote processing locations, but the invention is applicable to freezing systems in general.

B. Description of Related Art

Many methods are commonly used for preserving foodstuffs, including canning, salting, drying, retort pouching, smoking and freezing. However, all of these methods substantially alter the taste and texture of the preserved foodstuff that typify freshness, except freezing. Freezing can maintain the freshness of food, medical specimens and other items for extended periods of time and can be considered the preferred method of long term preservation for almost all foodstuffs, particularly seafood, meat, fruit and vegetables as well as baked goods. Blast freezing systems are known which are designed for freezing large quantities of comestibles such as meats, seafood, vegetables and bakery products, in a relatively short amount of time. Such systems work by subjecting the comestibles to air chilled to very low temperatures, such as −40 degrees F., for a period of time sufficient to completely freeze the product.

The process of freezing unavoidably changes the food product chemically, biologically and physically. The magnitude of these changes, and the resulting quality of the frozen food product, is greatly affected by many factors, including the rate, method and temperature of the freezing process, and the temperature and air quality during freezing and storage. Generally speaking, it is accepted that fast freezing rates and low consistent storage temperatures are necessary for high quality in most frozen food products. Fast freezing rates create smaller ice crystal formation and less migration of compounds that remain soluble during the freezing process, which greatly affects the taste and texture of the resulting frozen product. Depending on the type of foodstuff, some compounds continue to migrate after the product is considered frozen, further altering the taste and texture. Although recommended storage temperature very for different products, consistent low temperatures of −20° F. to −40° F. or lower reduce this migration to nil and are considered necessary for the high quality long term storage of most frozen food. So-called blast freezing systems have been developed to freeze foodstuffs at these temperatures quickly.

Another factor that greatly affects the quality of frozen foodstuff and other items is the elapsed time between harvesting and freezing. Most products, particularly seafood, begin to deteriorate rapidly after harvest, resulting in altered taste and texture making them less desirable in the market place. Fishing vessels, in order to sell to more particular markets and to stay on the fishing ground until full, must have suitable production equipment on board for freezing while at sea. Likewise, agricultural organizations must have production freezing equipment nearby, reducing the time between harvest and processing making the resulting product suitable for the more desirable markets that expect high quality frozen foods.

Freezing methods and systems are described in U.S. Pat. Nos. 6,235,332, 4,164,129, 5,452,588 and 3,696,631. The '332 patent describes a freezer system for freezing delicate fish filets and other items of food in a freezing tunnel. This device alternates product in-feed onto two or more freezing conveyors, where product is solidified enough to be gravity dropped onto a lower core freezing conveyor without product damage. This freezer uses less space than most for its capacity, however the space occupied by the belt returning on the underside of each conveyor to the end where it is reloaded is non-productive space inside the expensive low temperature freezing area. In contrast, the present inventive system distributes the freezing air more efficiently throughout the freezer and to the product in a more controlled manner, increasing overall efficiency and enabling more frozen product to be produced per hour as compared to the '332 patent. This prior system, as well as other systems, have often required more units of space per units of capacity than those presented herein. Additionally, this freezer is impractical for freezing larger items that require longer dwell times or are too heavy or delicate to drop onto the core-freezing conveyor without damage.

Another substantial advantage of the certain embodiments of the present invention over this and other prior art is a novel trolley design for comestibles which has the ability to configure the freezing area for a very wide variety of product on trays, belts or hanging structures. Additionally, the product density in the freezer is high, but the product remains in contact with the air or a freezing surface (e.g., product tray) on all sides. Additionally, the freezing surface upon which the product is carried through the '332 patent remains fixed within the freezer, resulting in a shut down of the entire freezer for cleaning at more frequent intervals then the present invention. Another advantage of certain embodiments of the present invention over the '332 patent is that is the present freezer design has the ability to provide consistent low temperature refrigeration to an adjacent storage facility, without requiring an additional refrigeration system.

Another prior art freezer is described in U.S. Pat. No. 4,164,129. This system provides for spiral, belt and trolley modes of freezing with various duct configurations, allowing their individual use with one refrigeration source. The system of the '129 patent uses a great deal more space for a given capacity than the present invention, making it impractical for shipboard or remote site installation. Furthermore, the spiral belt freezer, although providing similar continual throughput benefits as provided by the present invention, does not allow for variation in product gap, the space between the belts as it rotates around the center axis, thus limiting product versatility. Space is also not efficiently utilized in the '129 patent, as the entire center core area around which the belt rotates is not utilized. Additionally, the freezing system of the '129 patent would likely have to be shut down for more frequent cleaning, and uses a belt which is limited to a very narrow range of small products such as peas or diced vegetables. The trolley mode of operation in the '129 patent is a batch approach to freezing, which requires more labor and scheduling than continual throughput systems and does not provide the benefits of auto loading or variable spacing and hanging configurations.

A ship-board freezing system is set forth in U.S. Pat. No. 3,696,631. This patent relates to brine freezing onboard a fishing vessel, specifically a deck mounted brine freezing apparatus and integral hold refrigeration system. Brine freezing is often used for shrimp and other similar product and is accomplished at warmer temperatures than desirable for many other freezing applications. While the system of the '631 patent may be well suited for its intended purpose of brine freezing shrimp, it is not suited for broad use on a variety of different comestibles.

Advanced Food Processing Equipment, Inc. has developed a drag-through dolly tunnel freezer under the trade mark DRAG TUNNEL™ designed for continuous production. However, the Advanced system is not designed to be moved from one place to another. The location and arrangement of the evaporator configuration in the freezing cell is such that it occupies a considerable volume of space in the cell that could otherwise be devoted to product. Accordingly the capacity of the DRAG TUNNEL™ product is reduced from what it otherwise could be.

Another freezer company, IceBits, has developed a blast freezer using dollies loaded with comestibles. However, the IceBits blast freezer is designed as a batch system, meaning that the freezer is loaded with dollies, the dollies sit in the freezer until the comestibles are frozen, the dollies are removed, and a new batch of dollies are placed in the freezer. The IceBits freezer thus has a relatively low throughput as compared to a freezer designed for continuous production, such as the systems like the Advanced Food Processing Equipment DRAG TUNNEL™ product.

Another company, Seattle Refrigeration, has developed a batch-type blast freezer designed to be housed in a standard shipping container. While the Seattle Refrigeration blast freezer system offers mobility, its use of a batch mode of operation, with three or four batches per day, reduces the productivity of the system as compared to what continuous production systems can provide. This system is also more labor intensive and requires extra equipment. It also has an inefficient evaporator design that is believed to result in uneven freezing rates for product, higher dehydration from the product, and associated frost formation problems.

The world-wide expansion and globalization of food producing entities has greatly increased the need for versatile production freezing equipment that can produce very high quality products, suitable for installation onboard fishing vessels, processing vessels and land based installations in remote areas of the world, as well as more conventional plant locations near industrial centers. Another desirable feature is for the freezing system to provide the refrigeration necessary for the frozen product storage area, thereby eliminating the need for a separate refrigeration system. Another desirable feature is for the freezing system to be containerized and or modular, suitable for manufacturing complete or near complete at the factory enabling easy shipment and commissioning at a remote site. Another desirable feature is for the freezing system to be portable, suitable for moving to new areas as individual fish run seasons are completed, or the harvest of one crop is completed and the freezing capacity is needed elsewhere. Production freezing equipment represents a major investment for most organizations and is therefore important for the equipment to be versatile and suitable for a wide variety of products.

The art has lacked a mobile (i.e., transportable), continuous production blast freezer with a high throughput that meets these needs. Some of the embodiments of present invention meet that need by making high quality continuous production freezing attainable, practical and economical in a wide field of applications, including ship-board freezing, freezing at remote sites, and in other areas where a mobile, high throughput continuous production blast freezer may be desirable.

While some of the features of the preferred embodiment are specifically designed and adapted for use in mobile, i.e., portable freezer application, others features of the disclosed embodiments are capable of employment in freezer systems generally, as will be apparent from the following discussion. For example, the novel evaporator configuration, insulated enclosure designs, trolley designs, and/or automated loading and unloading features can be used with existing freezing systems such as described above.

SUMMARY OF THE INVENTION

In one aspect, a freezing system for continuous production of frozen comestibles is provided. The system includes an insulated enclosure having an entrance for receiving comestibles to be frozen and an exit for delivering frozen comestibles. A heat exchanger comprising an evaporator is positioned along one side of said enclosure and extending along the length of the insulated enclosure. One or more fans are provided for blowing air in the insulated enclosure through said evaporator in a manner substantially transverse to the longitudinal axis of said enclosure. In a preferred embodiment, the evaporator has a high capacity to depth ratio. This minimizes frost buildup and moisture removal from the product, as explained below.

In one possible configuration, the system also includes a plurality of trolleys individually moveable within the enclosure between the entrance and the exit. The trolleys are designed for holding comestibles to be frozen, either on trays, on hooks or on mesh supports, or in any other appropriate manner for the comestibles. The trolleys contains adjustment features enabling the placement of the comestibles in the trolleys to be changed depending on the size of comestibles.

The insulated enclosure may take the form of a modified standard shipping container and, as such, can be sized and adapted to be readily transported from one place to another by ship, rail or truck. The container is modified by adding insulation to the walls of the container and installing a refrigeration system, including a heat exchanger in the interior of the container to provide a means for removing heat from the container. The rest of the mechanical equipment for the refrigeration system (condenser, valves, etc) can be placed elsewhere in or on the container itself, in a separate container, or provided exterior of the container in any convenient fashion.

Preferably, the refrigeration system comprises an evaporator placed within the container and one or more fans arranged to blow air over the evaporator and through the trolleys in a direction substantially orthogonal to the direction of movement of the trolleys through the container. A preferred evaporator has a high capacity to depth ratio (where "depth" indicates the distance parallel to the fins in the direction of air flow across the evaporator), and has reduced frost formation characteristics as described below.

The trolleys, in a preferred embodiment, have a solid panel on at least one side thereof to substantially block the longitudinal flow of air in the enclosure. This helps form discrete temperature zones in the container and reduce buildup of frost at the exit location of the enclosure.

In another aspect, a trolley is provided for holding comestibles to be frozen by a freezing system. The trolley comprises a base, and a set of vertical support members extending above the base adapted to receive a plurality of trays holding comestibles to be frozen. The vertical support members having a plurality of closely spaced adjustment features to enable trays to be placed at multitude of different vertical positions in the trolley.

High capacity production freezing systems with continuous throughput may also employ an automated station for removing trays from the trolleys loaded with frozen product, and automatically loading the trolleys with trays loaded with product.

Numerous configurations for the subject freezing system are contemplated. One possible embodiment includes dual insulated containers arranged side by side and separated by a vertically oriented evaporative heat exchanger. Other embodiments will also be described. The subject freezing system of the present invention allows for high capacity continuous throughput freezing that offers portability and transportability that has not been realized in prior art blast freezing systems.

BRIEF DESCRIPTION OF THE DRAWINGS

In FIG. 5, only one pair of tray or hook support rails are shown, it being understood that many more such tray support rails will be typically used with a single trolley depending on the size of the product to be frozen, the spacing from the trays from each other, and the number of trays or hooks each that is used with each trolley.

DETAILED DESCRIPTION OF REPRESENTATIVE PREFERRED AND ALTERNATIVE EMBODIMENTS

Overview

Figure 1:
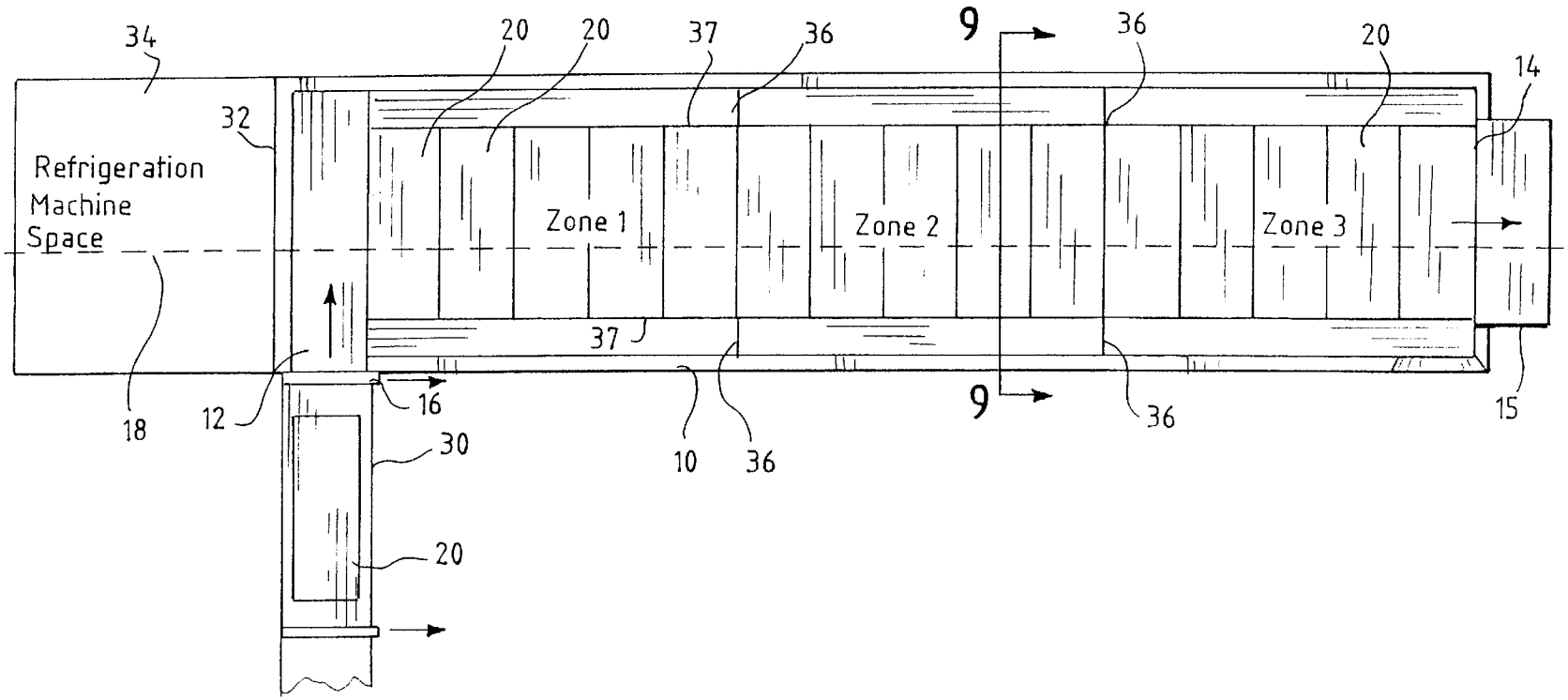
FIG. 1 is a schematic diagram showing the general arrangement and layout for a portable, continuous production blast freezer system in accordance with a representative embodiment of the invention. In the embodiment of FIG. 1 the refrigeration machinery is incorporated into a modified standard shipping container, which also forms the insulated enclosure.

Referring now to FIG. 1, the general arrangement of one representative embodiment of a continuous production blast freezer system is shown. The arrangement includes an insulated enclosure 10 forming a chamber or cell in which product to be frozen is introduced at one location, an entrance 12, and having a second location in which frozen product is removed from the enclosure 10, at an exit 14. The system includes a refrigeration system for freezing the product, comprising an evaporative heat exchanger placed within the enclosure 10 and an associated refrigeration condensing unit (not shown in FIG. 1). The refrigeration system includes fans mounted within the enclosure 10 that blow air through the evaporator in a direction generally transverse to the longitudinal axis 18 of the enclosure. The complete self-contained continuous production blast freezer plugs into any usable power source to power the self-contained refrigeration system. An alternative configuration would be to connect one or more insulated enclosures 10 with resident evaporators up to existing and remotely located refrigeration condensing units.

The product to be frozen is carried on a multitude of adjustable trolleys, shown schematically in FIG. 1 at reference 20. The trolleys are loaded with product in a product loading station and loaded into the enclosure 10. A drive system is provided in the enclosure for moving the trolleys through the insulated enclosure 10. As soon as one trolley has moved away from the entrance 12 of the enclosure 10, another trolley is loaded into the enclosure. The system of FIG. 1 is a continuous production system, in that the trolleys are continually loaded with product and introduced into the enclosure at the entrance 12, and trolleys with frozen product are continuously unloaded from the exit 14. The rate at which the trolleys move within the enclosure and frozen product is ejected, the length of time required to freeze the product, and the length of the enclosure are all factors that must be considered when manufacturing the freezer system of FIG. 1 for any given application, and will vary with the product in question, the temperature of the air in the enclosure, the temperature of the product when it enters the enclosure, and other factors. However, with say a 45 foot enclosure, and 15 trolleys filling the enclosure, the system is quite flexible. Varying product refrigeration times can be achieved simply by varying the rate of movement of the trolleys through the enclosure and the dwell time between loading new trolleys loaded with product. The system of FIG. 1 can freeze 3,500 to 4,000 pounds of 6 lb. salmon per hour (outputting one trolley loaded with 720 pounds of frozen product every 12 minutes), or roughly 80,000 pounds of salmon per day with a 22 hour per day duty cycle.

The system of FIG. 1 also includes an optional air lock entrance vestibule 30. The vestibule is designed as pre-chilling station where moisture from the product and initial cool-down of the product and trolley is performed in order to minimize frost build up in the enclosure 10. A trolley loaded with product is placed in substantially air-tight entrance vestibule 30 for say 10 minutes. A fan and one or more evaporators are housed in the entrance vestibule 30. Air cooled by the evaporator blows over the trolley and product and gradually lowers the temperature to the temperature of the enclosure 10 (e.g., −40 F.) while removing moisture from the air. An air-lock door 16 is provided separating the entrance vestibule 30 from the enclosure 10. At the end of the 10 minutes, the door 16 is open and the trolley is moved into the entrance station 12 in the enclosure 10. The air lock door 16 is then closed, then the loading door for the vestibule opens and a new trolley loaded with product is then placed in the entrance vestibule 30. The process repeats until the first trolley loaded into the freezer enclosure 10 has made its way through the freezer to the exit 14. The total time in the enclosure may be on the order of 2–3 hours, sufficient to freeze the product. The process of loading trolleys 20 into the entrance vestibule and then through the enclosure 10 repeats continuously.

The embodiment of FIG. 1 can be either fixed or designed to be built around a standard 45 foot shipping container. In the shipping container embodiment, the container is modified to add a layer of insulation inside the floors, walls and roof of the container, thereby forming the insulated enclosure 10. A bulkhead 32 is installed in the container to separate the refrigeration space from a space 34 designed to accommodate the refrigeration machinery.

Preferably, but not necessarily, the flow of air in the enclosure 10 is designed to be predominantly in a direction transverse to the longitudinal axis 18 of the enclosure 10, by means of placement of fans in the enclosure 10 and orienting the fans in the transverse manner. The trolleys 20, in a preferred embodiment, have a solid panel on one side thereof extending transverse to the longitudinal direction (when the trolleys are positioned in the enclosure) which helps promote the transverse flow of air. Additionally, baffles 36 are formed in the side of the enclosure 10 which closely abut the side regions 37 of the trolleys. Alternatively, the baffles can be eliminated and the width of the trolleys expanded such that they extend substantially the entire width of the enclosure, thereby achieving more product space utilization in the trolley. The baffles (or full width trolleys), together with the inherent temperature characteristics resulting from introducing relatively warm product at one end and outputing completely frozen product at the other end, results in temperature zones forming in the enclosure. The first zone (Zone 1) will have a relatively warmer temperature due to the presence of the relatively warmer product. The third zone (Zone 3) will be much colder due to the product having been in the enclosure for several hours before it makes its way to the third zone. The temperature of the middle zone (Zone 2) is between the two. The amount of heat removed from the third zone is much less than that from the first zone. Excess cooling capacity of the third zone can be used to refrigerate adjacent spaces, such as a vessel hold, freezer for frozen product, etc. For example, apertures can be formed in Zone 3 and suitable duct work and fans provided to conduct cold air from the apertures to the adjacent space.

Figure 2:
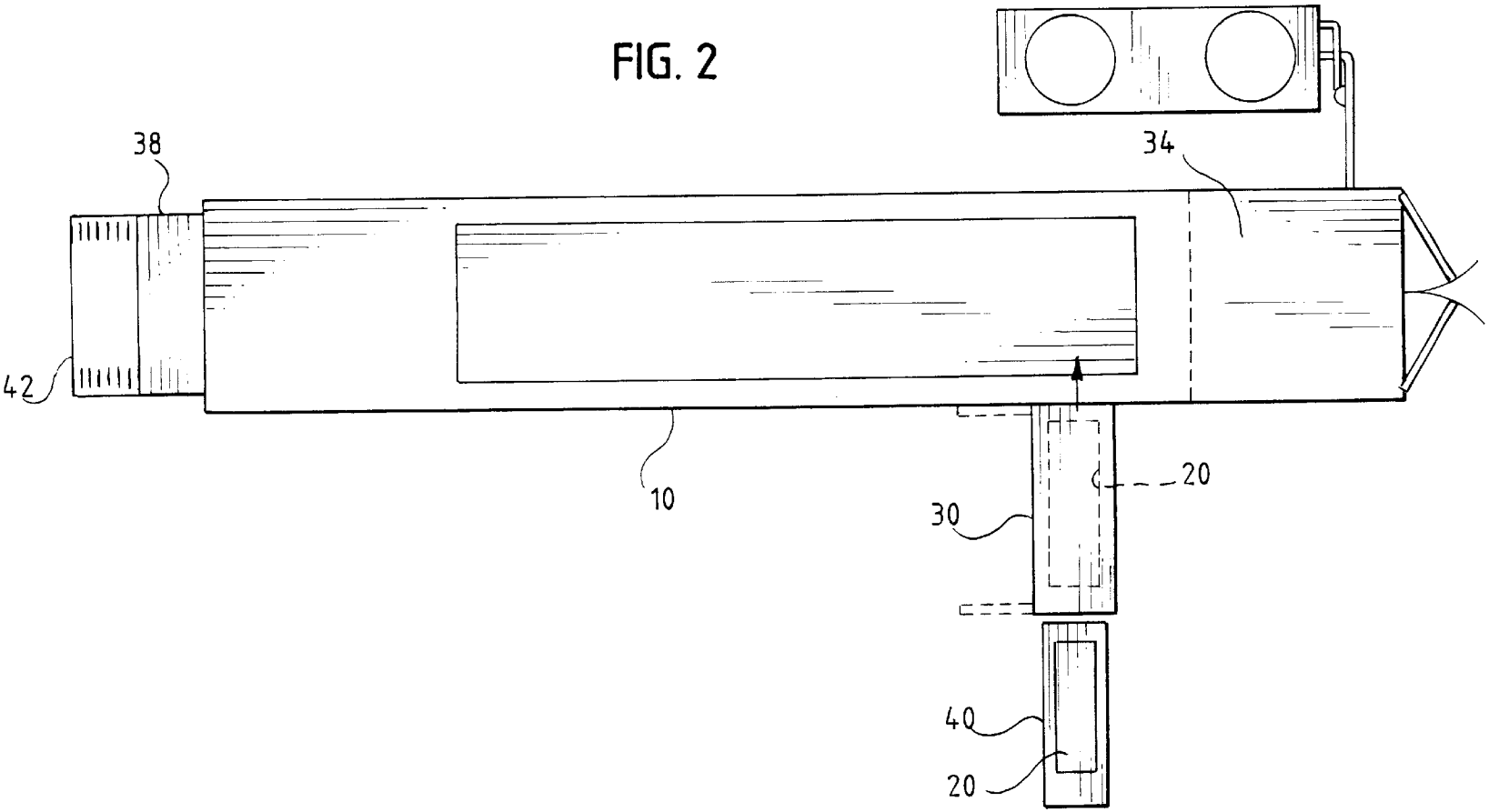
FIG. 2 is a schematic diagram showing a slightly modified version of the embodiment of FIG. 1, in which the refrigeration machinery is separate from the insulated enclosure.

FIG. 2 is a schematic diagram showing a slightly modified version of the embodiment of FIG. 1. The refrigeration machinery is located in a refrigeration machine space 34 separate from the insulated enclosure 10. The trolleys 20 in this embodiment have no wheels and instead have a flat bottom frame structure that is designed to roll on rollers in well known fashion. A roller apron 40 is shown adjacent to the entrance vestibule 30. The trolley 20 rolls over the rollers into the entrance vestibule 30 which also has rollers forming the floor thereof. The floor of the insulated enclosure 10 comprises a set of rollers for allowing the trolleys to roll down the length of the enclosure. A suitable chain or belt drive system is also installed in the floor of the enclosure which has features for engaging the base of the trolleys 20 and moving the trolleys down the length of the enclosure 10.

When the trolleys have made it to the exit vestibule 38, the trolleys loaded with frozen product are moved onto an exit roller apron 42 and conducted to a product unloading station (not shown). A roller apron (not shown) is preferably provided between the product unloading area to the entrance apron 42 or adjacent product loading station to provide a means for return of the trolleys to the front of the line for reloading and reuse. Of course, alternative methods could be used, such as providing a dolly or wheel arrangement for the trolleys, placing them on pallets and moving them around with a pallet jack, or using wheeled trolleys.

Figure 3:
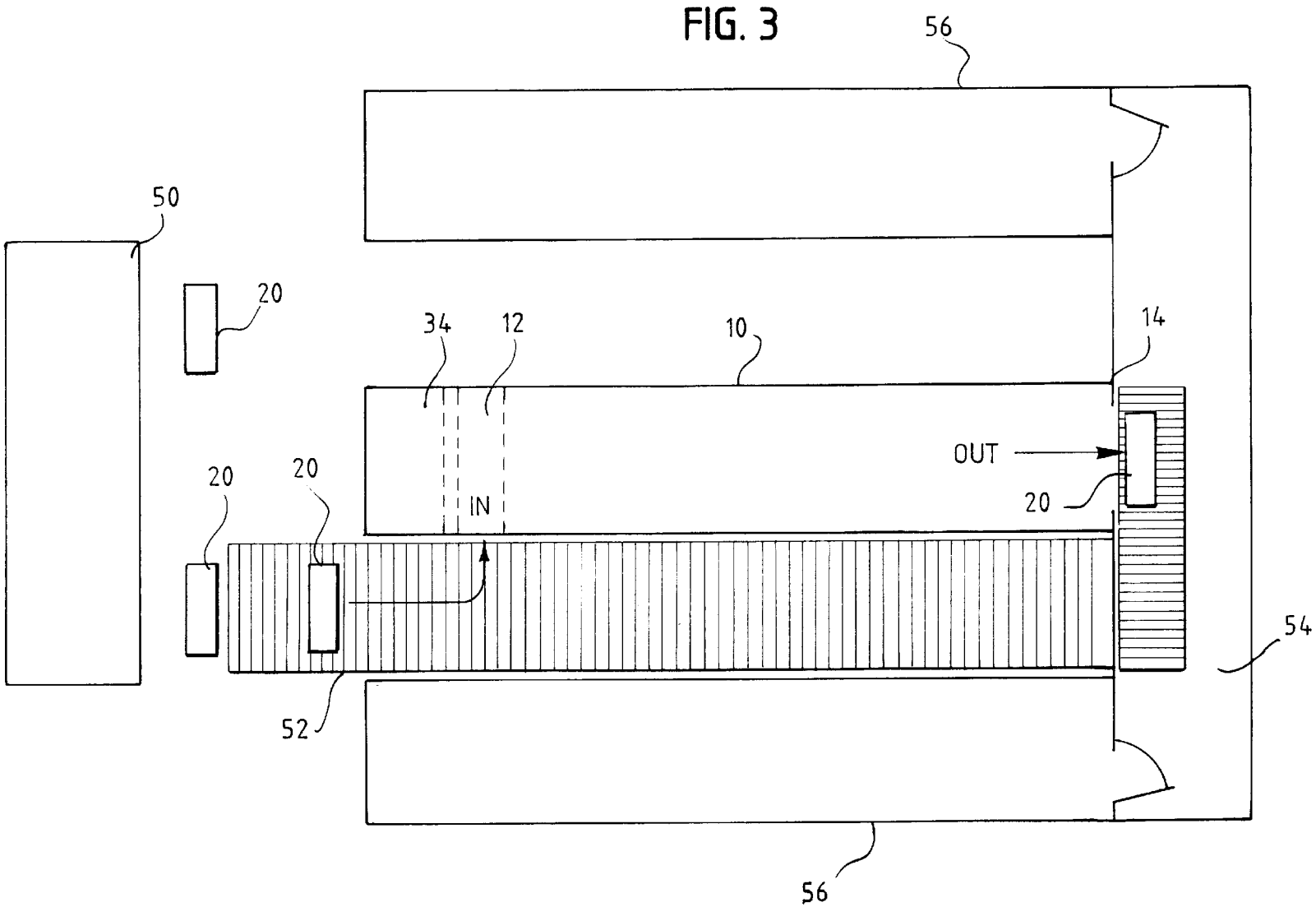
FIG. 3 is an illustration of an example of a freezer plant layout which uses the freezer system of either FIG. 1 or FIG. 2 which has the capacity for producing 80,000 pounds of frozen product per day, enough to fill two forty foot refrigerated shipping containers.

FIG. 3 is an illustration of an example of a freezer plant layout which uses the freezer system of either FIG. 1 or FIG. 2 which has the capacity for producing 80,000 pounds of frozen product per day, enough to fill two forty foot shipping containers. The system includes a product preparation area 50, where product (e.g., fish, baked goods, etc.) to be frozen is loaded on trolleys 20. The trolleys are placed on a side roller apron 52 and loaded into an entrance vestibule (not shown) or placed directly in the entrance 12 in the insulated enclosure 10. Frozen product is off-loaded from the enclosure at the exit 14. The system includes a glazing and boxing area 54. Frozen product is loaded into two standard 40 foot shipping containers 56, each with a capacity of 40,000 pounds.

Figure 4:
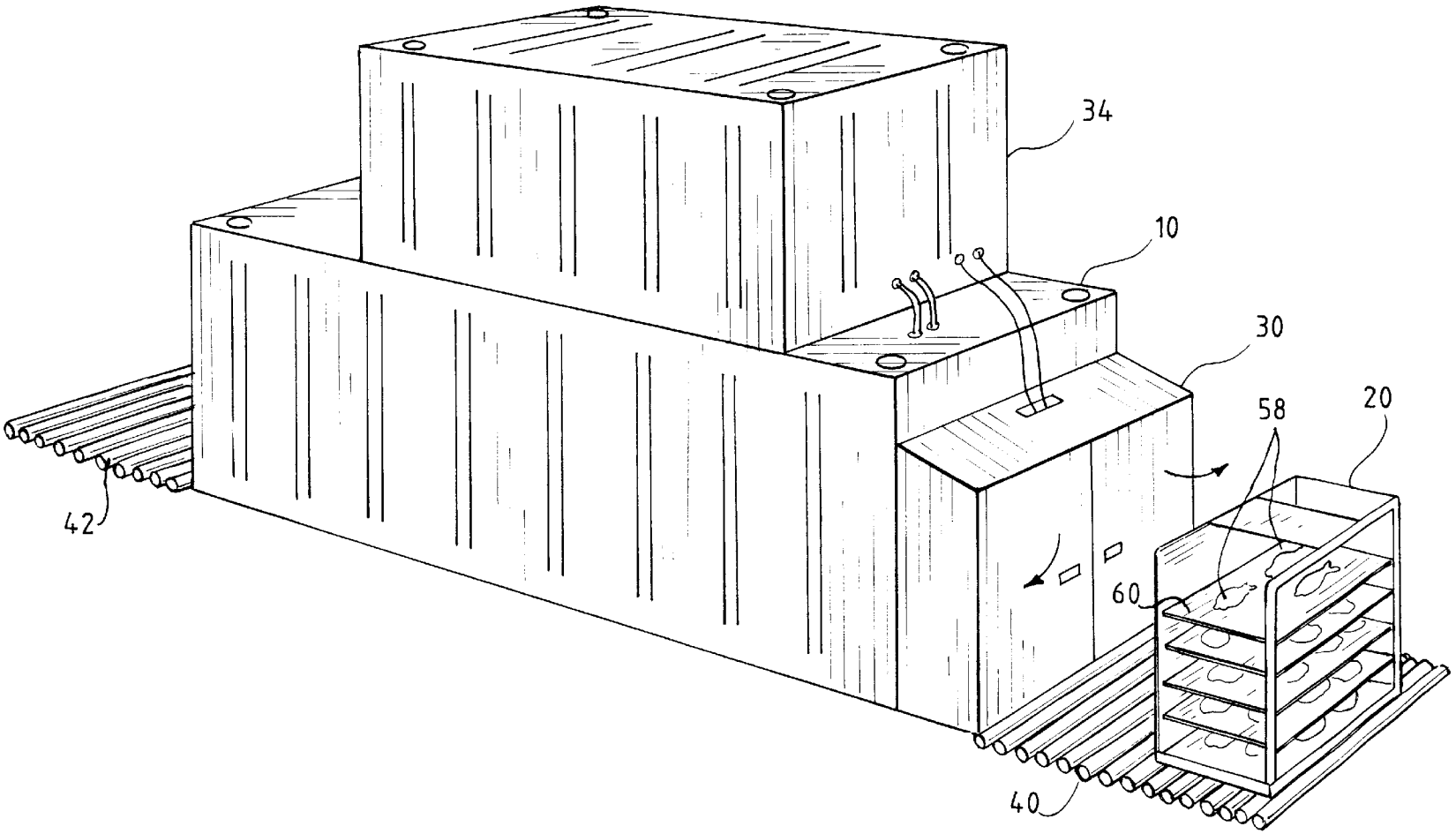
FIG. 4 is a perspective view of an alternative configuration of the inventive freezer system, in which the refrigeration machinery is packaged in its own shipping container separate from the main freezer insulated enclosure.

FIG. 4 is a perspective view of an alternative configuration of the inventive freezer system in which the refrigeration machinery is packaged in its own shipping container 34 separate from the main freezer insulated enclosure 10. In this embodiment, the insulated enclosure 10 consists of a standard 40 foot shipping container open at one end for receiving trolleys 20 loaded with product 58 from the entrance air-lock vestibule 30. The trolleys loaded with product move longitudinally through the enclosure and exit from the enclosure onto an exit apron 42. The size of the trolley 20 and product 58 in FIG. 4 is not necessarily to scale relative to the enclosure 10, in order to better illustrate the general arrangement of the trolley and the trays 60 in the trolley that hold the product 58.

Trolley Design

Figure 5:
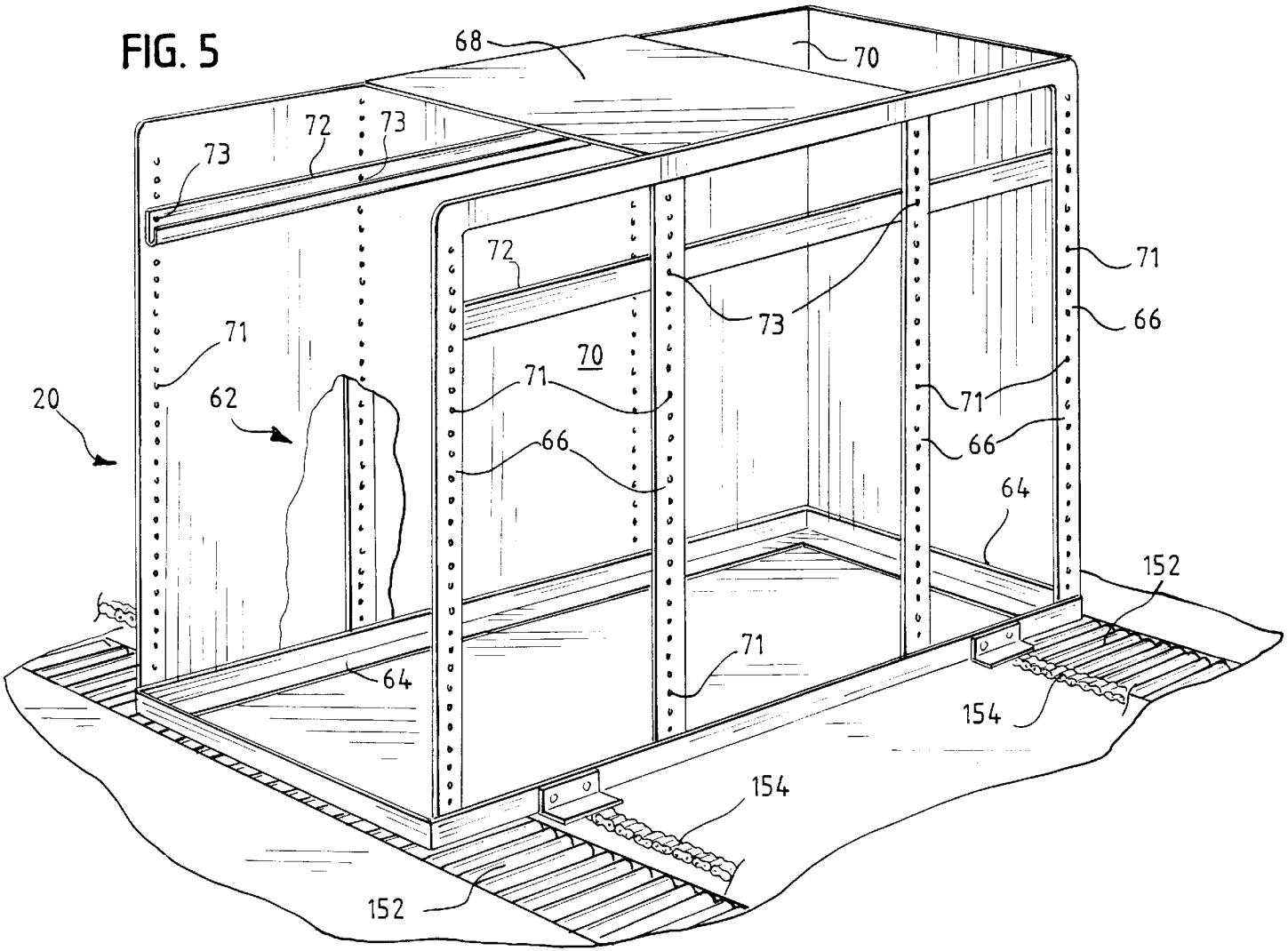
FIG. 5 is an illustration of a perspective view of a trolley designed to hold either product trays or hooks for hanging product to be frozen. A set of the trolleys of FIG. 5 is used with any of the embodiments of FIGS. 1–4. The number of trolleys per set depends on the length of the insulated enclosure, the amount of extra trolleys needed for packing and unloading stations, and other factors.

FIG. 5 is a perspective view of a trolley 20 designed to hold either product trays 60 or hooks for hanging product to be frozen. A set of the trolleys 20 of FIG. 5, perhaps 15–20 or more, is used with any of the embodiments of FIGS. 1–4. The number of trolleys 20 per set depends on the length of the insulated enclosure, the size of the trolleys, the amount of extra trolleys needed for packing and unloading stations, and other factors. The trolleys are designed to maximize the amount of volume for product in the insulated enclosure, considering the placement of the refrigeration system and other elements inside the enclosure 10.

The trolleys include a frame structure 62 comprising a base 64 and vertically oriented supports 66. The trolleys are open on at least one end 66 in order to slide trays loaded with product into the trolley. A support member 68 extends across the frame 62 to provide torsional strength for the frame 62. The trolley has a rectangular base and four sides, with one side thereof formed as a solid panel 70 in the illustrated embodiment. Alternatively, solid panels could be formed on opposite sides of the trolley. The solid panel is not necessary in some embodiments, such as where you do not need to prevent longitudinal airflow. The solid panel 70 extends transversely across the insulated enclosure when the trolleys are loaded into the enclosure 10 (FIG. 1), thereby substantially preventing longitudinal flow of air in the enclosure.

The vertically oriented supports 66 of the frame structure 62 have a multitude of positioning notches 71 or holes equidistantly spaced from each other. The notches or holes 71 engage complementary projecting features formed on the side of tray support rails 72. The tray support rails 72 can be positioned in a multitude of different positions within the trolley. Only one pair of rails 72 is shown in FIG. 5, it being understood that other pairs of rails 72 would be present depending on the required spacing between trays (depending on the height of the product on the tray). The rails 72 have projecting features 73 which engage the positioning notches 71 to securely affix the rails 72 to the supports 66. The rails 72 are designed to allow a tray 60 (FIG. 4) to slide along the rails and rest securely on the rails 72. Other tray holding configurations are of course possible and within the ability of persons skilled in the art in view of the present disclosure.

Figure 6:
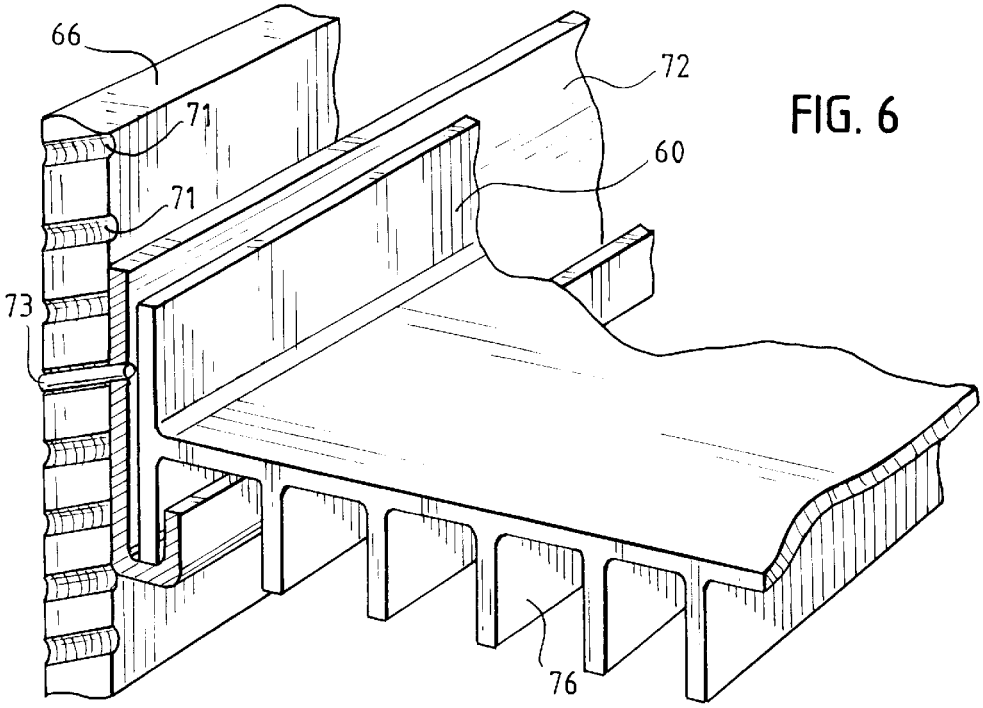
FIG. 6 is a detailed perspective view, partially in section, showing one embodiment of how the tray support rails are affixed to the vertical supports of the trolleys, and showing how the trays themselves fit into the tray support rail.

FIG. 6 is a detailed perspective view, partially in section, showing one embodiment of how the tray support rails 72 are affixed to the vertical supports 66 of the trolleys 20, and showing how the trays 60 themselves fit into the tray support rail 72. The support 66 includes a plurality of holes 71 which receive a pin 73 extending from the rail 72 to secure the rail 72 to the support 66. The rail has a J shaped cross section, with the lip of the J receiving the edge of a product tray 60 as shown in FIG. 6. The product rests on the top surface of the tray 60. The bottom surface of the tray may include optional heat exchanger-type fins 76 to promote conduction of heat from the product to the air in the freezer. The trays can be slid along the rail 72 to install the tray or alternatively lowered into place using an automatic loading and unloading mechanism, described in more detail later on.

Figure 7:
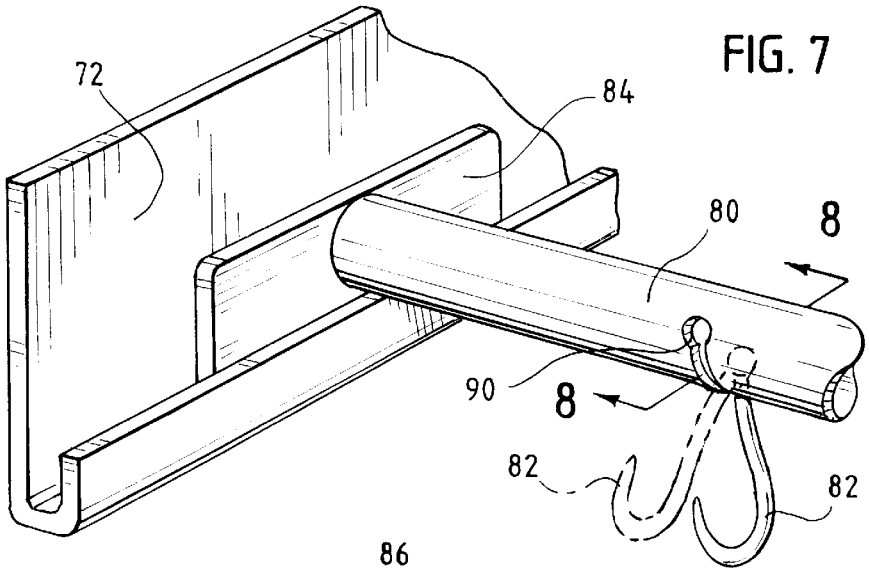
FIG. 7 is a detailed perspective view showing the attachment of a bar for hooks onto the tray support rail.
Figure 8:
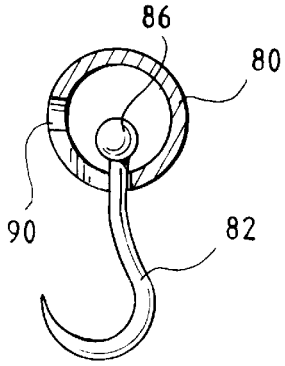
FIG. 8 is a cross-section of the bar of FIG. 7 along the line 8—8 of FIG. 7.

FIG. 7 is a detailed perspective view showing the attachment of a bar 80 for hooks 82 onto the tray support rail 72. The bar extends across the trolley and has an end flange 84 which rests in the J channel of the rail 72. The spacing of the hooks on the bar will depend on the size of the product to be frozen. Preferably, a slot runs the length of the bar which engage the end of a hook in any positions along the length of the bar 80. FIG. 8 is a cross-section of the bar of FIG. 7 along the line 8—8, showing a hook 82 secured in the bar 80. The head 86 of the hook 82 can slide into the bar along a slot 90 extending from above the bottom of the bar (see FIG. 7) and then moves down the slot until the hook is in the position shown in FIG. 8, where it cannot slip out accidentally due to the size of the head 86 being greater than the width of the slot 90.

The trolley design of FIG. 5, with the optional solid panel preventing longitudinal air flow in the enclosure, provides a number of benefits:

1) Separate temperature zones within the insulated enclosure 10 are possible.
2) Reduced warming of adjacent zones during defrost.
3) Air infiltration at the exit end 14 of the enclosure is minimized.
4) The exit area can be held at a more uniform temperature, as it is not subject to warm product loads from the entering end. Consequently, it is feasible to draw off some cold air from the enclosure 10 to refrigerate an adjacent space such as a vessel hold.
4) Air flow direction through each evaporator can be reversed with the same enclosure 10 by varying the orientation of the fans in the enclosure, exposing the product to more uniform temperatures and freeze rates.

Figure 23:
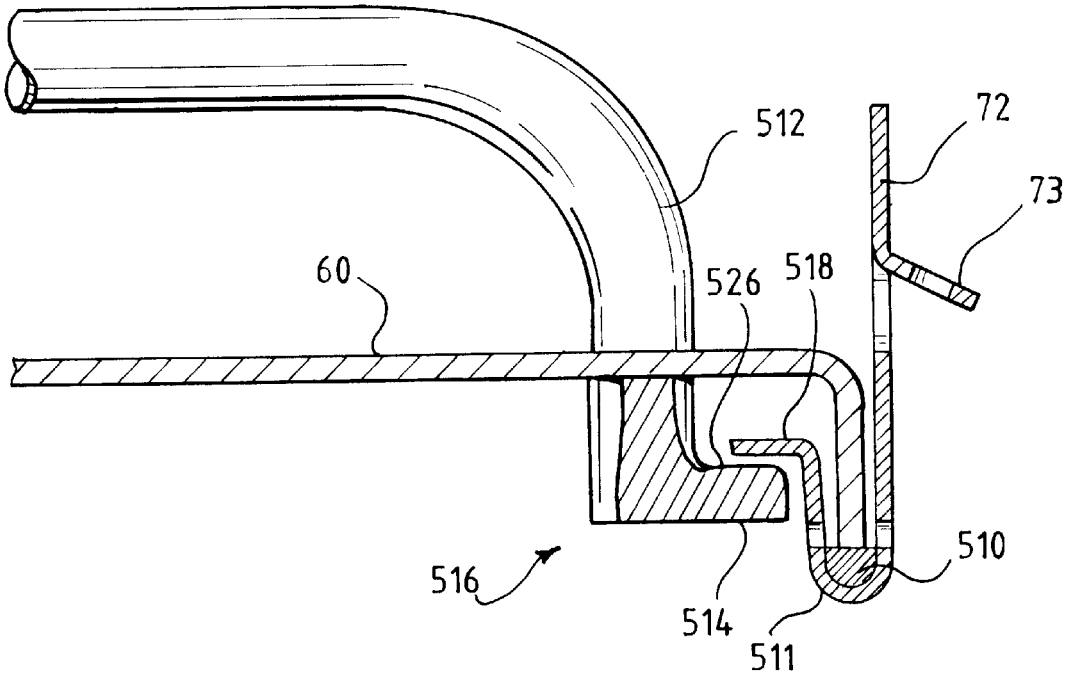
FIGS. 23–25 are illustrations of alternative arrangements of the trays and tray support rails for the trolleys with features to improve the loading and unloading of trays into the trolley.
Figure 24:
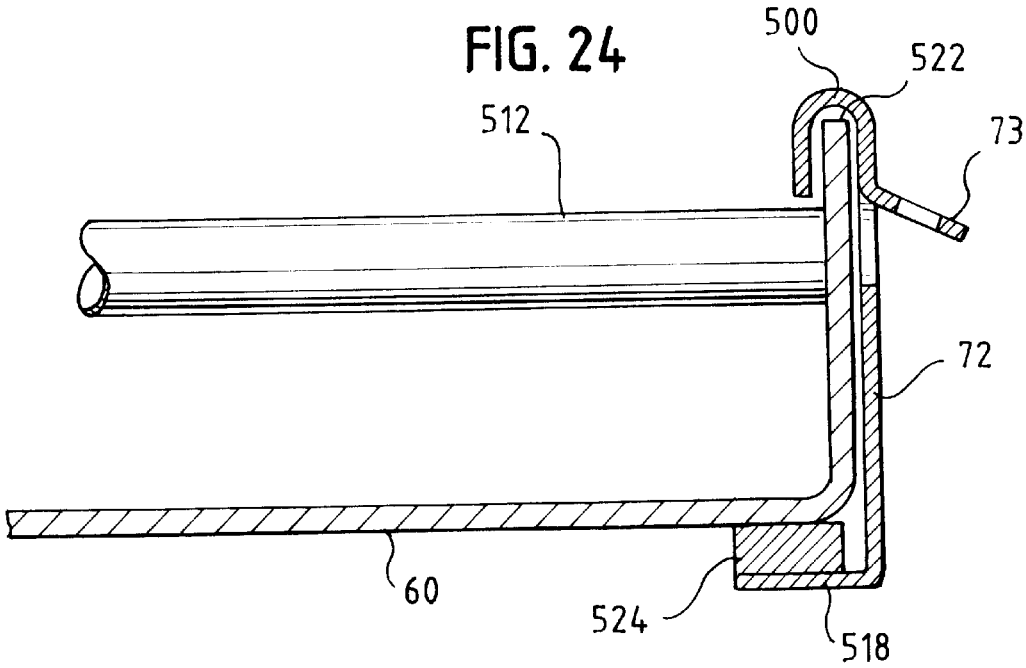
Figure 25:
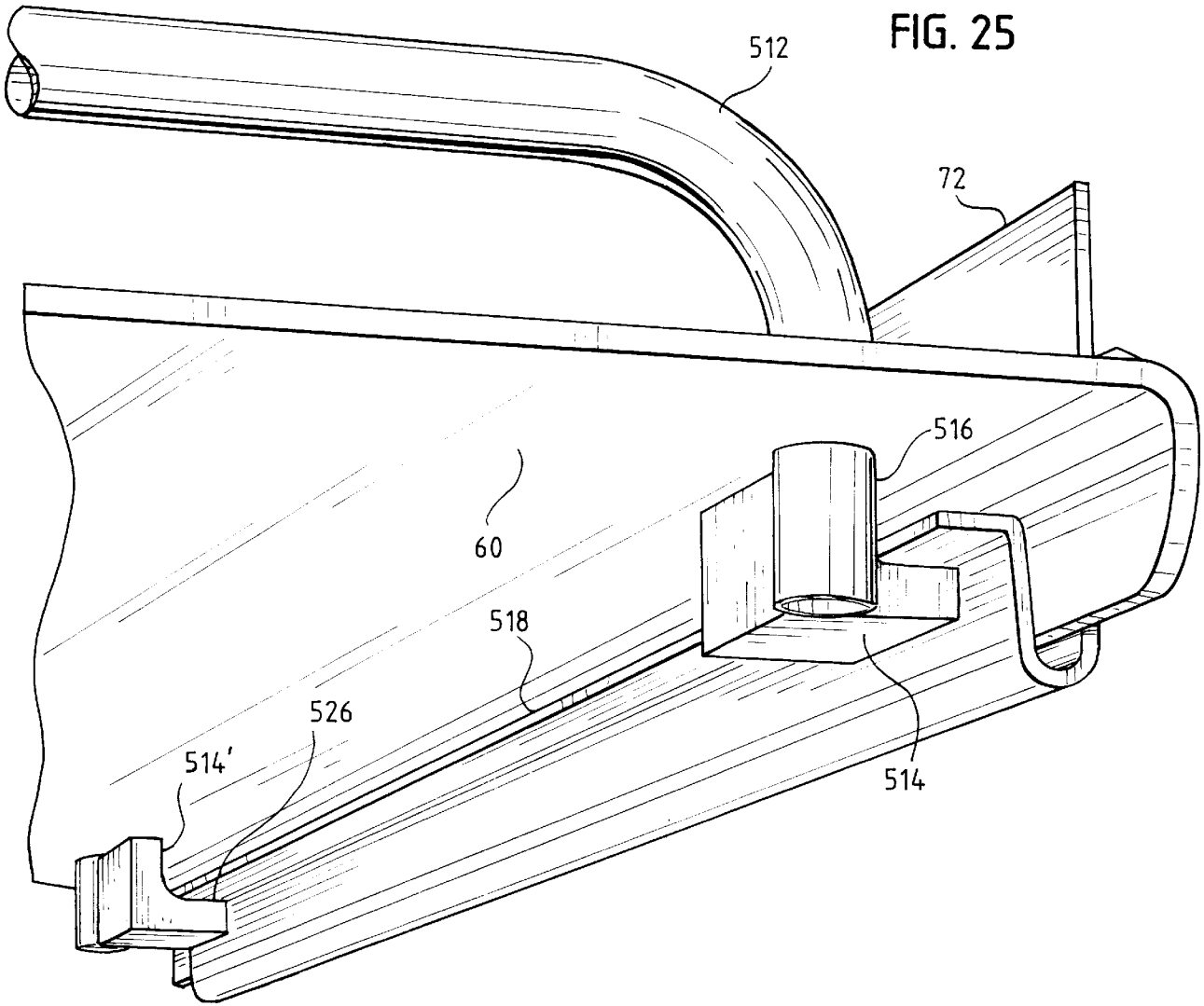

Alternative arrangements for the tray 60 and tray support rail 72 are shown in FIGS. 23 to 25. In FIG. 23, the tray support rail 72 includes an insert 510 of ultra high molecular weight (UHMW) plastic in the U-shaped portion 511 of the tray support rail. The UHMW insert 510 extends the entire length of the rail 72 and is provided on both rails on opposite sides of the trolley. The insert 510 provides a low friction surface allowing the tray 60 to slide easily in and out of the trolley. The rails 72 also include a inwardly projecting flange 518. The tray includes a handle 512 extending across one end of the tray and a block 514 attached to the lower surface of the tray adjacent to the lower end 516 of the handle 512. FIG. 25 is a perspective view of the embodiment of FIG. 23, showing the placement of the blocks 514 and 514' at both the end of the tray beneath the handle 512 and at the opposite end of the tray.

In a preferred embodiment, the trays and frame structure comprises features mutually cooperating with each other to permit the tray to be partially slid out of the frame structure 62 without substantial rotation of the tray relative to the frame structure, whereby loading and unloading of the tray may be facilitated. For example, the combination of the block 514' and flange 518 provide a feature whereby when the user grasps the handle 512 and pulls the tray partially or nearly all the way out of the trolley (by sliding along the UHMW insert 510) the tray 60 will not lift up off of the rail 72 (i.e., rotate relative to the frame structure) and not fall out of the trolley. In particular, as the tray 60 is withdrawn, the upper edge 526 of the block 514' abuts the flange 518 which prevents further rotational movement of the tray 60 relative to the tray support rail 72. This allows the worker to unload product from the tray, and load product back onto the tray, without completely removing the tray from the trolley or interfering with other trays, increasing loading speed and convenience. The UHMW insert 510 also lowers the amount of force required to break each tray loose and slide it out of the trolley for loading and unloading. Obviously, the UHWM or other low friction material could be incorporated on the tray 60 instead of the support rail.

FIG. 24 shows an alternative arrangement that provides the same sliding and tray retention features as in FIGS. 23 and 25. In this embodiment, the tray support rail 72 includes an upper inverted U-shaped feature 500 which captures the upper edge 522 of the tray 60. The tray support rails also includes a flange 518 and a UHMW block 524 affixed to the upper surface of the flange 518. The weight of the tray 60 is borne by the low friction UHMW block 524. When the user grasps the handle 512 and pulls the tray 60 out of the trolley, the tray 60 slides along the UHMW block 524, while the coaction of the upper edge 522 against the U-shaped feature 500 prevents the tray from rotating up and out of the trolley.

Heat Exchanger Arrangements within Enclosure 10

Figure 9:
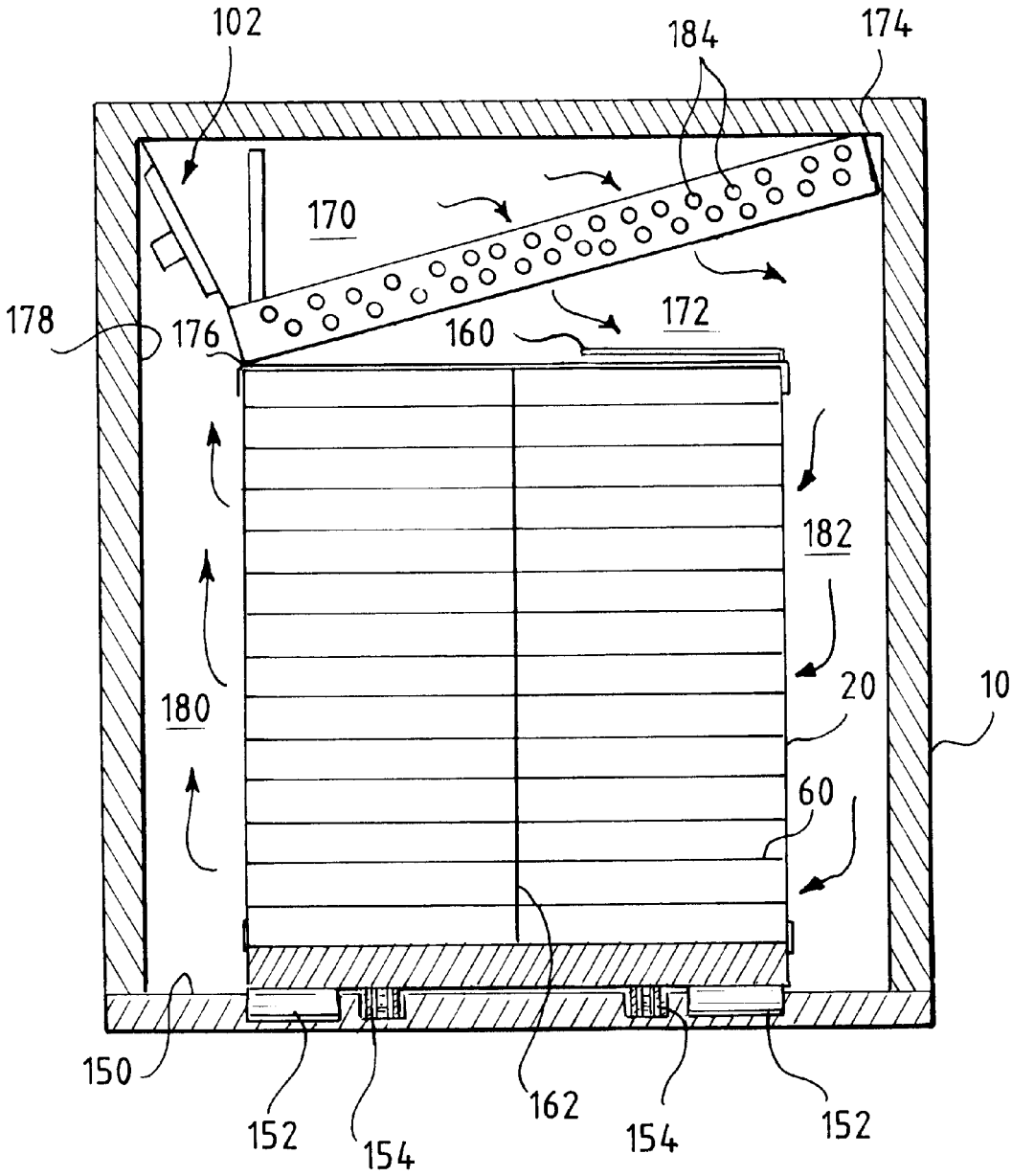
FIG. 9 is a cross-sectional view through the insulated enclosure of FIG. 1 along the lines 9—9, showing a trolley within the enclosure and showing the evaporative heat exchanger arranged above the trolley and fan for circulating air in a manner generally orthogonal to the longitudinal axis of the insulated enclosure.

FIG. 9 is a cross-sectional view through the insulated enclosure 10 of FIG. 1 along the lines 9—9, showing a trolley 12 within the enclosure 10. A set of evaporative heat exchangers 100 are mounted to the upper portion of the enclosure 10 above the trolleys and extend along substantially the entire length of the insulated enclosure between the entrance station and the exit station. The evaporators are preferably high capacity to depth ratio, as described in more detail below. This is indicated in FIG. 9 by the width of the evaporator 100 in the direction transverse to the airflow being much larger than the thickness or depth of the evaporator, and the fact that the evaporator 100 has a longitudinal extent either most of the entire length of the enclosure, or substantially the entire length of the enclosure 10.

The evaporators 100 are positioned in a diagonal fashion so as to take up a minimum of space in the enclosure 10 and allow the trolley 12 to carry as much product as possible. A set of fans 102 are spaced along the length of the enclosure adjacent to the evaporators, one of which is shown in FIG. 9. The fans are mounted to the upper region of the enclosure in any convenient manner. The fans circulate air in a manner generally orthogonal to the longitudinal axis of the insulated enclosure in the direction indicated by the arrows. The air flows through the interior of the evaporative heat exchanger 100, where heat from the air is absorbed by the fins in the heat exchanger. The air blows down the side of the enclosure and across the product, loaded on the trays 60. The trays 60 can be spaced relative to each other to equalize the flow of air across the trays (e.g., by separating the trays more in the bottom portion of the trolley as compared to the top portion). The number of heat exchangers to place within the enclosure, their size and cooling capacity are all design details that will vary depending on the cooling requirements of the given situation. Persons skilled in the art will be able to account for these factors and arrive at a suitable arrangement for the heat exchangers and the fans.

With reference to the embodiments of FIGS. 9, 15 and 16, the diagonally oriented evaporator 100 forms triangular air plenums 170 and 172 above and below the evaporator 100. One edge 174 of the evaporator is close to or in contact with the enclosure 10 along its longitudinal extent, substantially blocking the airflow around that edge 174. Another longitudinal edge 176 is in close proximity to a product carrying device (such as a trolley 20) and a distance away from the enclosure wall at 176, thereby creating an airflow path around that edge 176 of the evaporator 100. When product belts, trays and/or trolleys are used to carry product through the device, airflow passages 180 and 182 are left open between the product and the sides of the enclosure.

When an air moving means such as fans 102 are used to move air through the air plenums and passages 170, 172, 180 and 182, such moving air is confined to a path where it is caused to pass through the evaporator 100 where it is cooled, while transferring heat to the coolant within the heat exchanger tubes 184. When the air is moved through the product the air is warmed by absorbing heat from the product and this heat is removed by the evaporator.

Air is delivered to the full face area of the evaporator (longitudinal length of the evaporator multiplied by the height, or distance between the edges 174 and 176). Similarly, the air is delivered to the area of the product to be frozen as represented by the side of the trolley 20 adjacent to the air passage 182.

Figure 14:
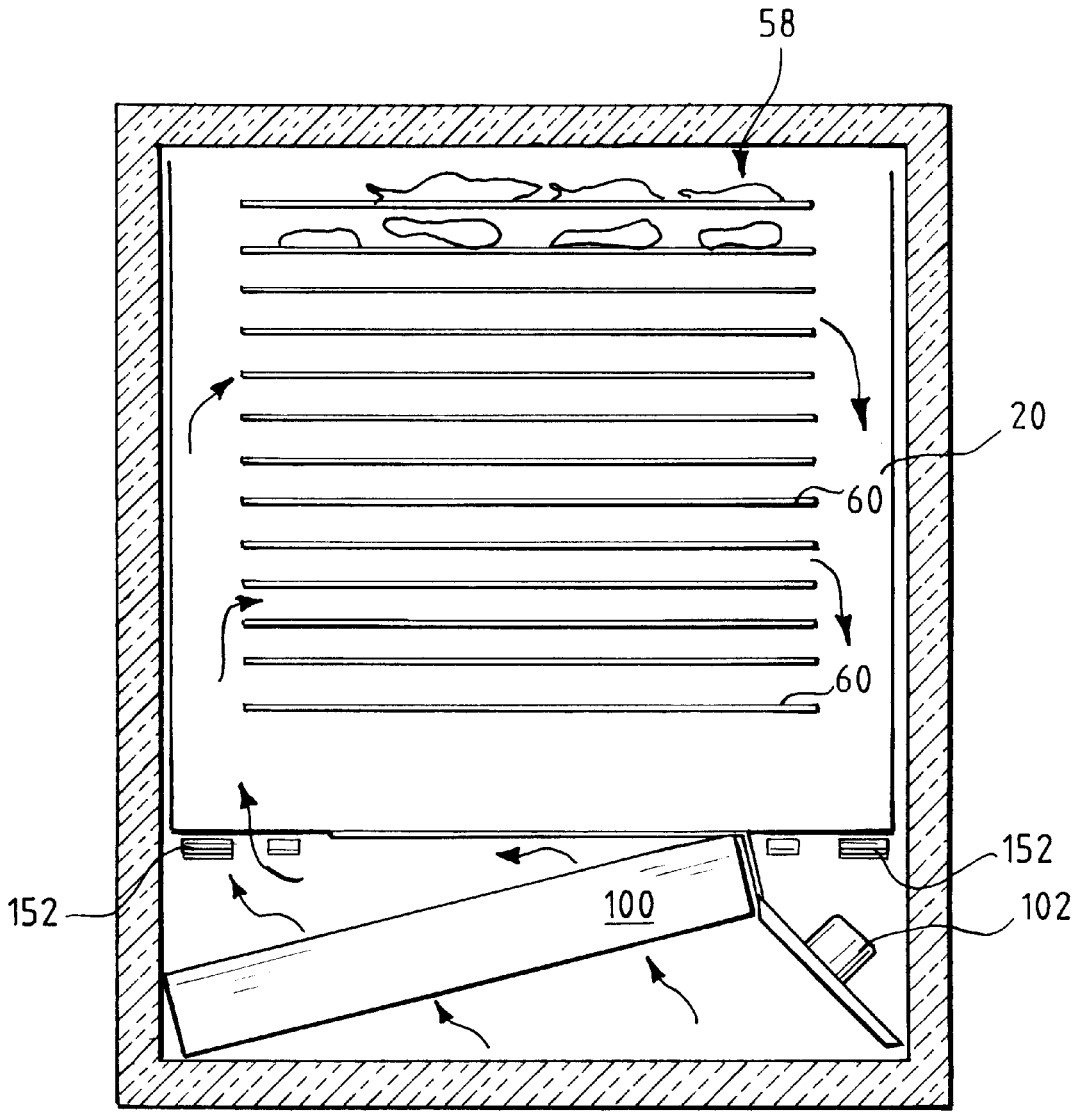
FIG. 14 is a cross-sectional view of an embodiment of the freezing system in which the evaporator heat exchanger is placed below the trolleys.
Figure 17:
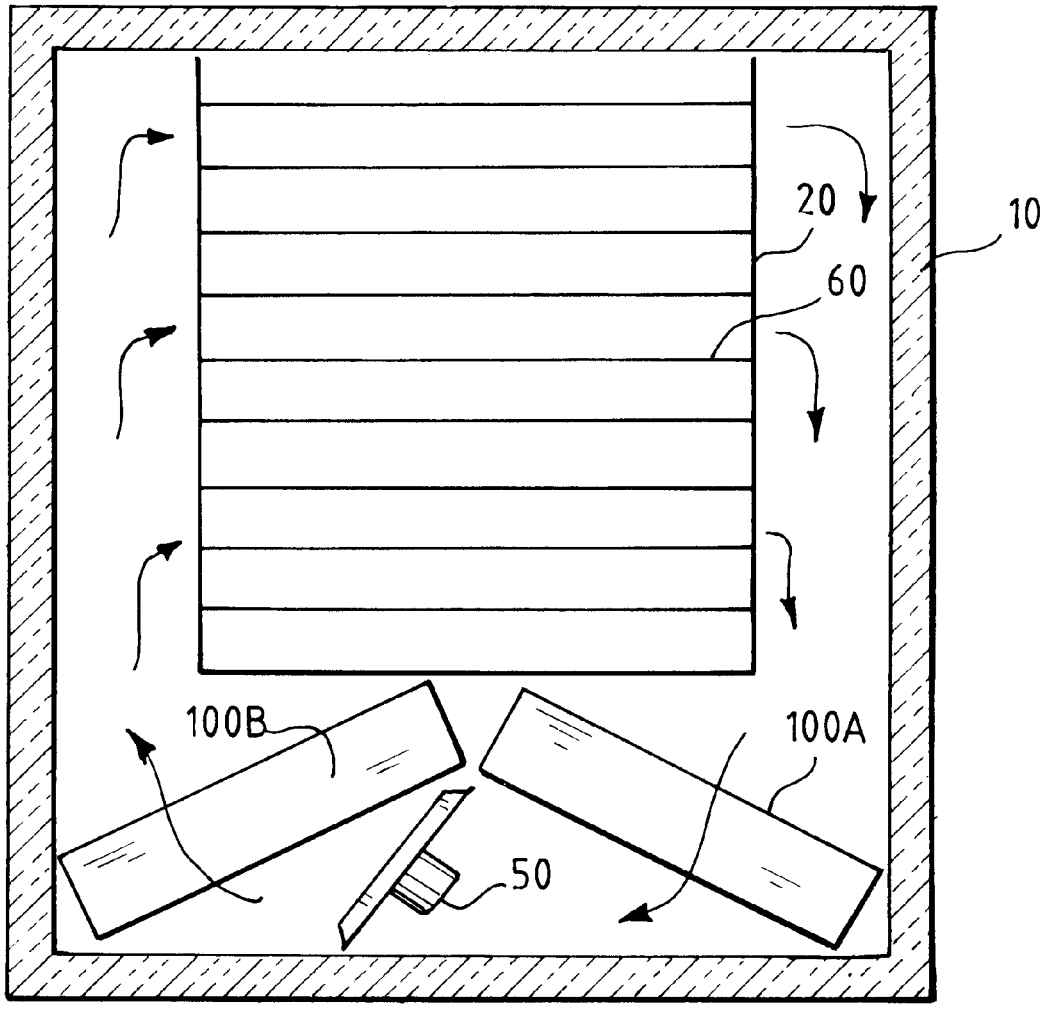
FIG. 17 is an illustration of an alternative arrangement of the evaporator in which dual evaporators are placed at an angle below the trolleys within the container to maximize space available for the trolleys.

These principles of evaporator and enclosure interrelationship and air flow through the enclosure and product are also applicable to the embodiments of FIGS. 14 and 17.

Louvers and product spacing variations can be used to enhance the uniformity of airflow velocity through the evaporator and the product to be frozen. The exact placement of louvers will be dictated by geometry of the enclosure, the configuration of the evaporator, the location of the fans, and other factors, and will be within the ability of persons skilled in the art. When hanging product is moved through the product freezing enclosure 10, product can be placed across the full width of the enclosure 10 provided sufficient spacing exists between product for airflow. The airflow path through the product is created and controlled by the separation of the product.

The defrost pan 160 (FIG. 9), when partially retracted in the freezing mode, forms another portion of the air plenum 172. The high velocity air is further distributed through the product by the product trays 60, the spacing of which can be varied to optimize air velocity through the product. Alternatively, when product is hanging vertically, product spacing can be varied both transversely across the trolley and vertically. A center divider 162 can be placed in the trolley 20 which extends from the top of the trolley down as needed to direct airflow down through half of the product and back up through the other half as it returns to the fans and evaporator. The center divider 162 can be partially opened to obtain lateral airflow in the upper half, if desirable. The short air path through the product and high face area and high air velocity allow the freezer to operated with less temperature variation decreasing product dehydration and improving freeze rates.

Multiple evaporators 100 can be used in conjunction with the zone divider feature of the product trolley solid panels to create separate temperature zones within the freezer. The separate temperature zones can be used to reduce the freeze time and energy input. The separate freeze zones (see FIG. 1) effectively block air passage between zones within the enclosure 10, making it feasible to reverse airflow directions along the length of the enclosure, making freeze rates even more uniform. The separate temperature zones also allow the exit 14 (FIG. 1) of the freezer enclosure 10 to provide refrigeration for adjacent storage facility such as a cold storage room or vessel hold, making it unnecessary to provide separate refrigeration systems for such facilities.

Figure 26:
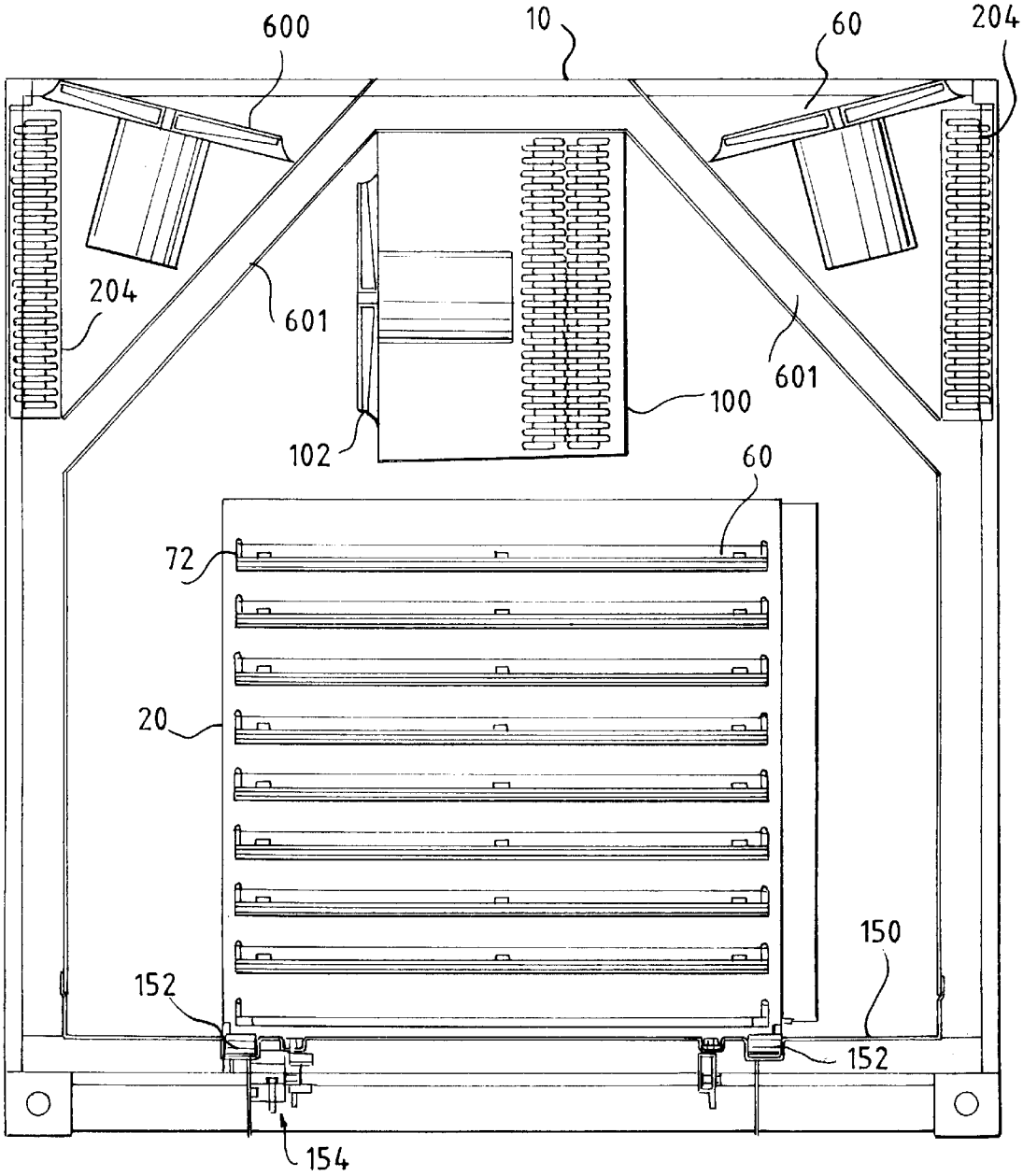
FIG. 26 is an end view of a continuous throughput blast freezer in which an air-cooled condenser is used in the refrigeration system; the air-cooled condenser is shown incorporated into the corners of the container, exterior of the insulated enclosure.
Figure 27:
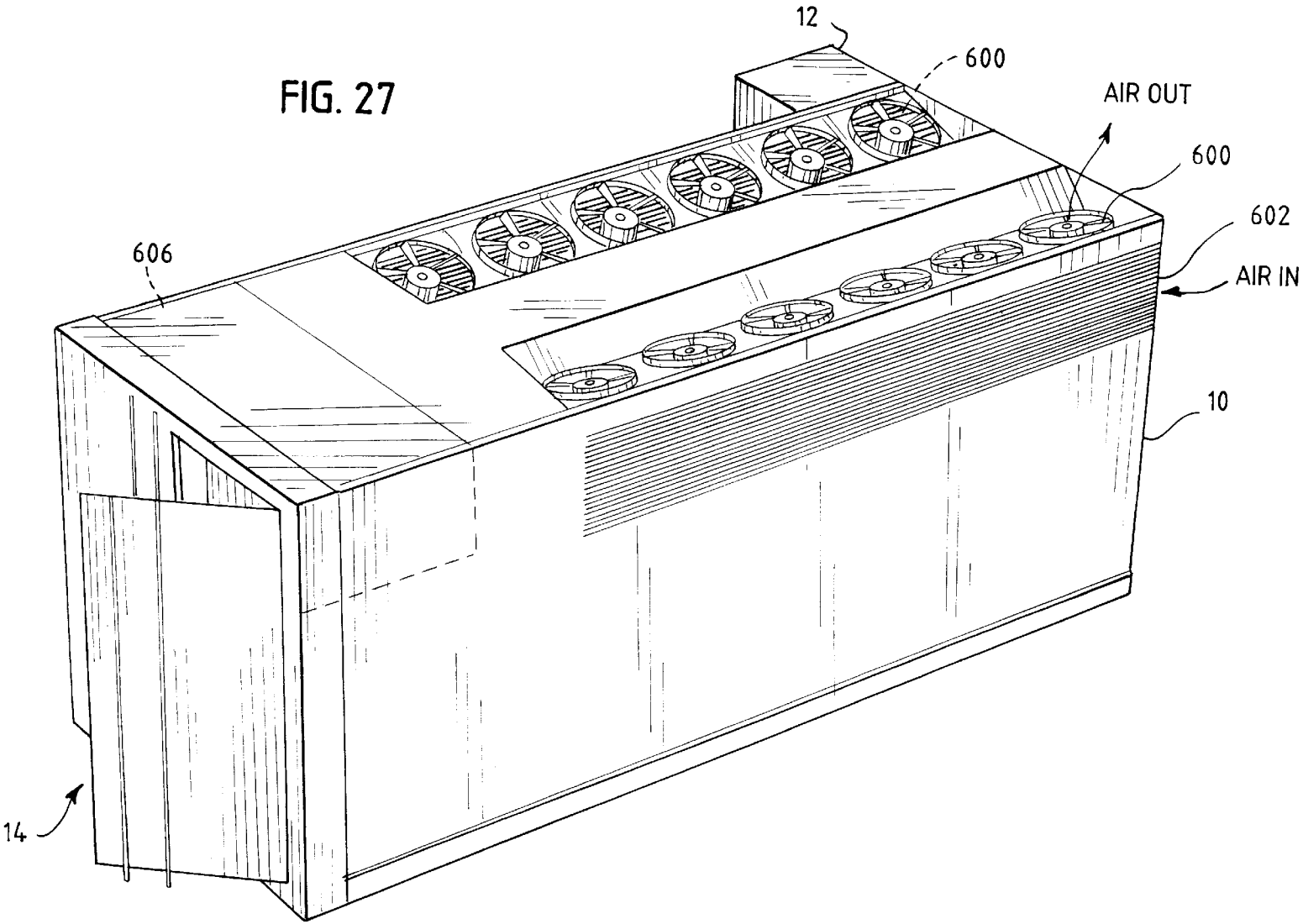
FIG. 27 is a perspective view of the embodiment of FIG. 26.

An alternative arrangement of a refrigeration system is shown in FIGS. 26 and 27. The system has a pair of air-cooled condensers 204 positioned in the upper corners of a standard shipping container exterior of the insulated enclosure 10. The air-cooled condensers are within the "envelope" of the dimensions of a standard shipping container and do not protrude outside of the envelope, allowing the entire unit to be transported in a stacked condition with other containers aboard a ship or transported in a standard rail car or truck adapted for transporting shipping containers. The air-cooled condensers condense and supply liquid refrigerant to an evaporative heat exchanger 100 that extends in a longitudinal direction down the length of the interior of the enclosure 10. A fan 102 circulates air through the enclosure transverse to the longitudinal axis of the enclosure and through the fins of the evaporator 100. The air-cooled condensers 204 include fans 600 that direct air from apertures 602 in the sides of the container through the condensers and out the top of the container, as shown in FIG. 27. Insulated walls 601 separate the chilled interior of the enclosure 10 from the relatively warm air adjacent to the fan 600 and condenser 204.

The design of FIGS. 26 and 27 allows an air-cooled condenser to be incorporated within the envelope of a standard shipping container without decreasing evaporator space or freezing capacity. The benefits include portability and a system that can be completely self-contained, requiring no field assembly. All that is required is a source of electrical power for the machinery in the cooling system, including the fans 102, 600, and any drive system such as the chain drive system 154 for moving the base of the trolley 20 over the rollers 152 provided in the floor 150 of the enclosure 10. It will be appreciated that the additional components for the refrigeration system shown in FIGS. 26 and 27 is now shown, but will be provided elsewhere in the enclosure 10, such as in the machinery space provided in one corner of the enclosure 10 indicated at 606 in FIG. 27.

Entrance Vestibule

Figure 10:
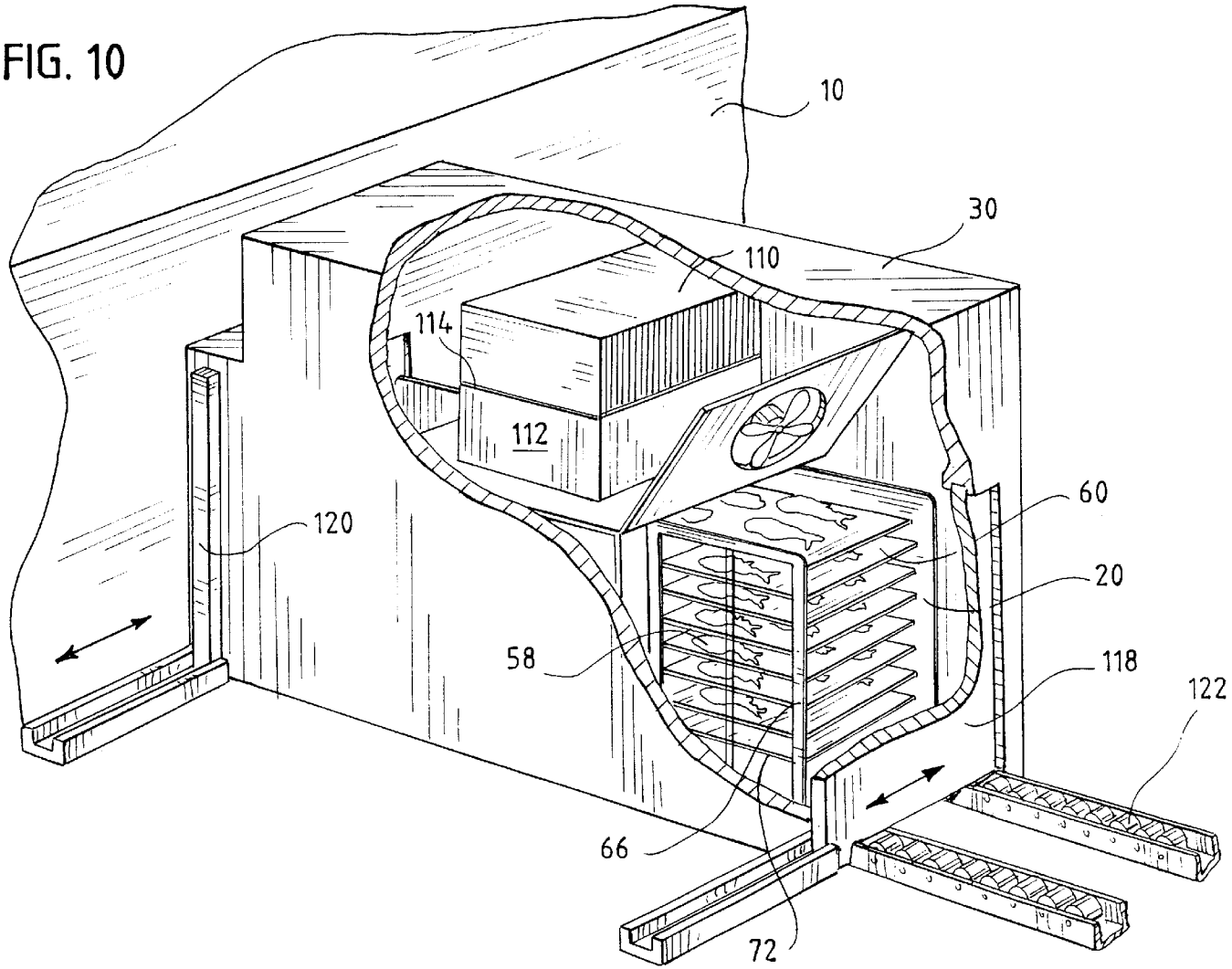
FIG. 10 is a perspective drawing, partially in section, of the entrance vestibule of FIG. 1 and FIG. 2.

FIG. 10 is a schematic drawing of the optional entrance vestibule 30 of FIG. 1 and FIG. 2. The vestibule 30 has two evaporators 110 and 112, separated by an insulated barrier 114. The evaporators 110 and 112 are expected to accumulate frost, therefore when one evaporator needs defrosting it can be taken off line and subject to a thermal defrost cycle, while the other evaporator remains operational. The thermal defrost cycle can use a variety of techniques, such as providing electrical resistance heating elements in the evaporators which cause the frost to melt. The evaporators have drain conduits (not shown) to drain the moisture away. A fan 116 is provided to blow cold air through the evaporators 110 and 112 and onto the product loaded on the trays 60. The air lock door 118 opens and closes to allow a loaded trolley 20 to enter the vestibule 30. Further, a rear air lock door 120 connects the entrance vestibule to the insulated enclosure 10. When the trolley 20 has been subject to the pre-chilling in the entrance vestibule (e.g., 10 minutes or other suitable time), the air lock door 120 opens, and a drive system positioned below the floor of the entrance vestibule 30 engages the base of the trolley and moves it over rollers 122 into the insulated enclosure for the transportation down the longitudinal axis of the enclosure 10.

Figure 11:
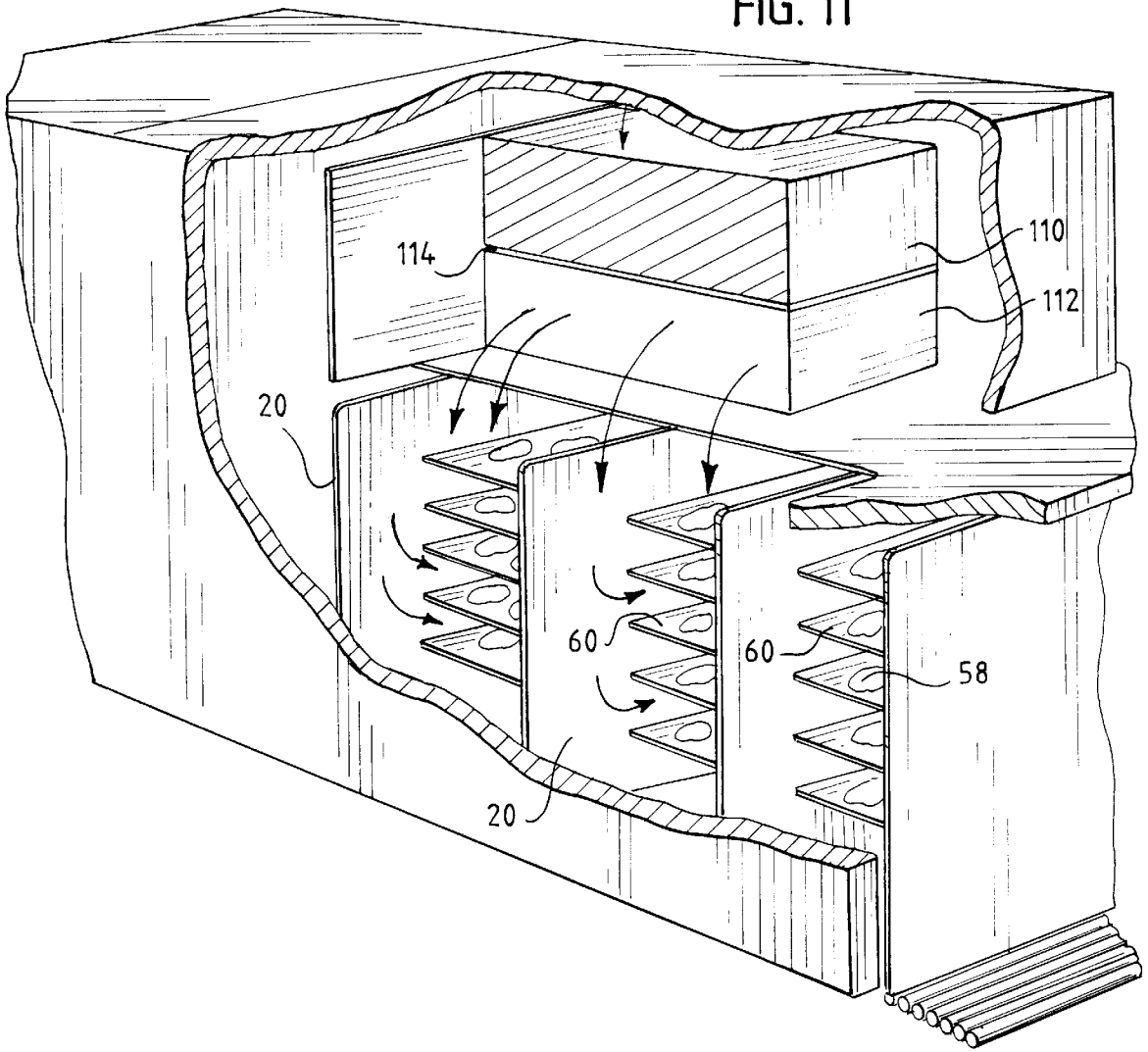
FIG. 11 a more detailed perspective view, partially in section, of dual evaporators placed within an entrance vestibule.

FIG. 11 a more detailed perspective view, partially in section, of dual evaporators 110 and 112 placed within an entrance vestibule 30. In this embodiment, three trolleys 20 move through the vestibule and are chilled by means for cold air from the evaporator 112 flowing over the product and trays as shown by the arrows. FIG. 11 shows the vestibule designed for entrance in the end of the enclosure, in an embodiment in which the product goes in one end and out the opposite end. Evaporator 110 is currently engaged in a defrost cycle and therefore is not operational, with evaporator 112 providing all the cooling for the product and trolleys in the example of FIG. 11.

Frost buildup on evaporator fins is detrimental to efficient freezing and must be removed periodically by running the affected evaporator through a defrost cycle. The evaporator being defrosted is temporarily taken out of refrigeration service, frequent defrosts are a nuisance and reduce effective freezing capacity. The source of frost-producing moisture within a blast freezer primarily comes from warm humid air infiltration and moisture removed from the product being frozen. The improved freezer design of FIG. 1 with the entrance vestibule of FIG. 10 substantially reduces moisture and resulting frost formation from both of these sources. The product entering vestibule of FIGS. 1 and 10 creates an air lock where a product trolley is chilled and the air's dew point is reduced to near the same dew point as the air within the main freezing cell. The pair of evaporators in the entrance vestibule, utilizing a low refrigerant evaporating temperature as the main freezing enclosure 10 and with a relatively low air velocity, maximized frost formation in the vestibule instead of in the main freezing enclosure 10. The dew point of the air within the vestibule is lowered prior to opening the air lock door and allowing the product to be moved to the main freezing enclosure. The pair of evaporators in the vestibule have moveable insulating barriers between them allowing alternating defrost cycles to be performed on the vestibule evaporators.

A reverse cycle defrost can be used for the evaporator 110. This is a accomplished by directing a portion of the compressor discharge gas that would otherwise be going to the condenser to the vestibule evaporator 110 while simultaneously closing off the gas line that supplies return gas to the compressor. Pressure will build in the vestibule evaporator until it reaches its condensing point or is equalized with the rest of the condenser circuit. This method delivers sufficient heat to the evaporator coil very quickly providing a very short defrost time, making it practical to use one evaporator for chilling with defrost occurring during the short period of vestibule loading, e.g. one minute or so. This would eliminate the need for a second evaporator in the entrance vestibule.

As shown in FIG. 1, a four-sided exit vestibule 15 is placed at the exit of the enclosure 10. The exit vestibule walls are designed to fit relatively close the edges of the solid panel on the trolleys 60. The exit vestibule 15 walls, along with the solid panel 68 of the trolleys effectively blocks air passage into or out of the enclosure 12 at the exit 14.

Conventional, prior art blast freezers typically push air longitudinally through the product carrying trays or trolleys, where air is progressively warmed as it passes through the product, thereby increasing its moisture content. The warmed air then passes through the evaporator. The moisture removed from the product is deposited on the evaporator fins in the form of frost. This detrimental process is much more severe in batch freezers where all product is warm initially, causing this warming—air humidification—frosts formation—cooling—dehumidifying cycle to be much worse than that provided with the system of FIG. 1. Thus, the combination of the features of the freezing system of FIG. 1, including the transverse air flow, high face area to surface area evaporator, air lock entrance vestibule, trolley panel design, and the exit vestibule which prevents or minimizes warm air entry into the exit end of the freezer, combine to significantly limit frost formation in the evaporators placed in the enclosure, allowing the refrigeration system in the enclosure 10 to run for longer periods between defrost cycles and generally operate more efficiently as compared to many prior art systems.

The entrance and/or exit vestibules can be built into the ends of the insulated enclosure. For example, the entrance vestibule need not be placed to the side of the enclosure but rather can be built into one end of the enclosure, with the exit vestibule built into the opposite end of the enclosure.

Alternative Arrangements

Figure 12:
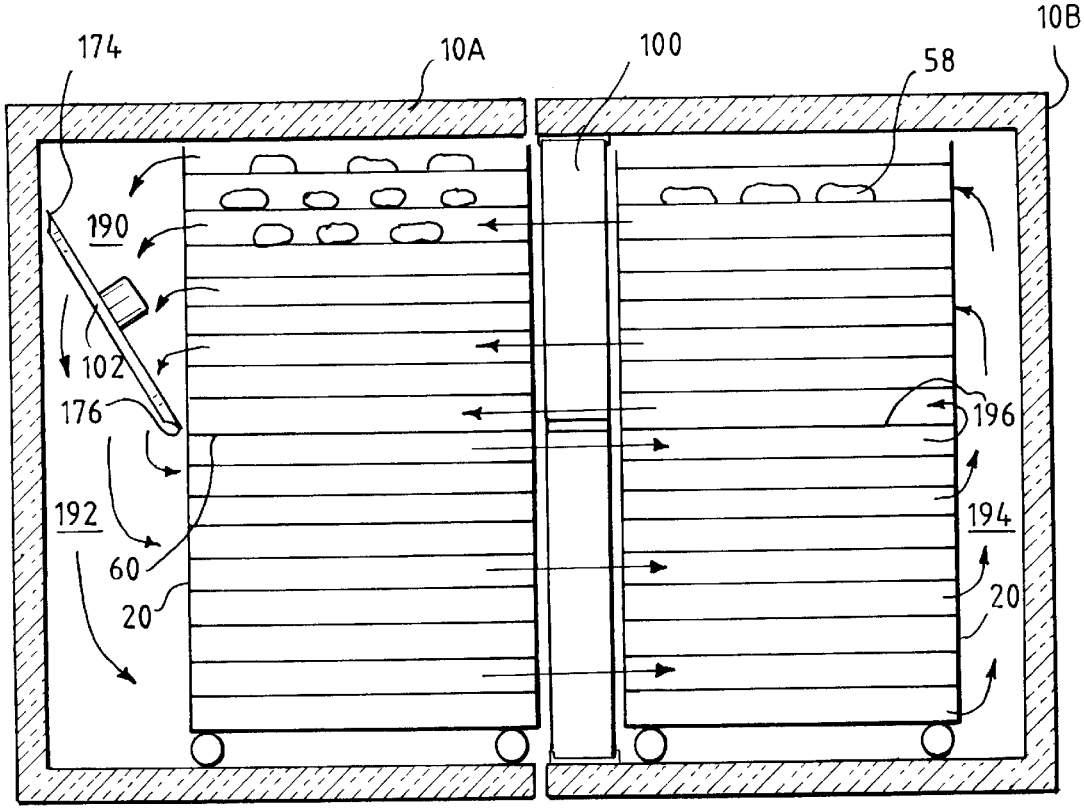
FIG. 12 is a cross-sectional view of a alternative arrangement of the freezing system in which insulated enclosures in the form of shipping containers are placed side by side, with one wall along the side of the container which has been partially removed from the shipping container to accommodate a vertically oriented evaporator. Additional structural supports for the wall containing, in part, the evaporator are not shown.

FIG. 12 is a cross-sectional view of an alternative arrangement of the freezing system in which insulated enclosures 10A and 10B, which could possibly be in the form of shipping containers, are placed side by side, with one wall along the side of each container 10A and 10B has been partially removed in order to accommodate an evaporator 100. Suitable structural supports remain in the wall containing the evaporator to support the enclosures. The vertically-oriented evaporator 100 is positioned down the length of the containers at the position of the missing or partially removed wall of the containers to thereby provide the heat exchanging element for both enclosures 10A and 10B. A set of fans 102 is placed along the length of one of the containers to provide for air flow across the product trays 60. The air flow is again in the direction transverse to the longitudinal axis of the containers 10. The lower-most edge of the fan housing 130 is positioned at approximately the same level as the middle of the trolleys 20. This arrangement of the fan and the trays in the trolley provides a mechanism for circulation of air through all the trays in the enclosure. Note that for the lower trays, the air flows from left to right across the product. The air hits the opposite wall of enclosure 10B and is directed upwardly, where it flows to the left across the product due to the low pressure at the inlet of the fan 102. Air flow baffles or barriers directing air through the product and dividing the upper and lower halves of the enclosures 10A and 10B can be built into the trolleys or as a stationary part of the units, or a combination of both. This configuration provides a high evaporator capacity and short air path through the evaporator and the ability to maintain high air velocity without excessive fan power. Very high production rates and product quality can be achieved with a relatively small freezing plant. One embodiment envisioned for this configuration would be to utilize two ISO shipping containers where one container contains the evaporator lengthwise along one side with a removable side panel. The other container would be placed along side the first container with adjacent removable panels creating a high capacity portable production freezer plant. Comparisons have been made with recent prior art available freezing plants where this new configuration of FIG. 12 would provide 2–5 times the freezing capacity for a given physical plant size. This configuration is well suited for high capacity applications. The system shown in FIG. 12, with an enclosure outside dimension of 24 feet wide by 12 feet high by 50 feet long for the enclosures 10A and 10B plus the evaporator, would provide a comparable capacity to a very large spiral freezer rated at 36,000 lbs. per hour, but would occupy significantly less floor space and overall volume.

Figure 13:
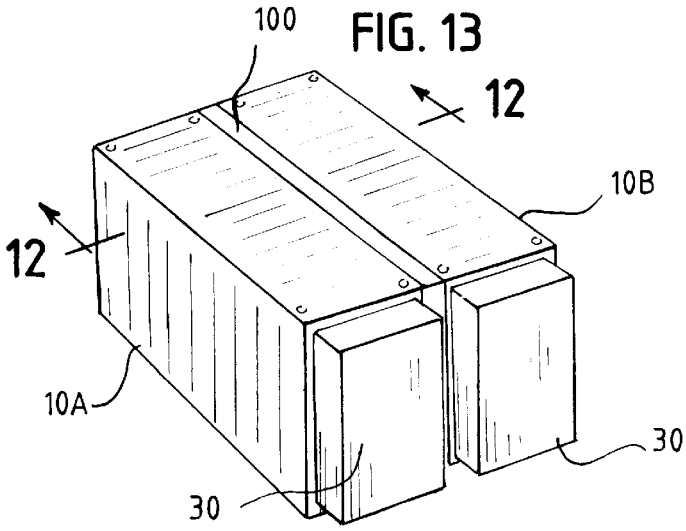
FIG. 13 is a perspective view of the system of FIG. 12.

FIG. 13 is a perspective view of the system of FIG. 12. Each container has its own entrance vestibule 30. In the embodiment of FIG. 12, the trolleys have wheels as shown and therefore entrance and exit roller aprons are not required.

The embodiment of FIG. 12 is applicable to any suitable pair of enclosure 10 and need not be shipping containers. For example, the embodiment of FIG. 12 could be a fixed, permanent freezer system in which the insulated enclosure 10A and 10B are any suitable insulated enclosure designed to be separated by a longitudinally arranged evaporator 100. Additionally, the embodiment of FIG. 12 can be used with a single enclosure, with the vertically oriented evaporator placed in the middle of a rectangular insulated enclosure and extending longitudinally down substantially the entire length of the enclosure, allowing product to pass down either side of the evaporator.

In the embodiment of FIG. 12, the fan 102 is placed with one edge 174 placed against the wall of the enclosure 10A and the other edge 176 placed closely against the tray 60 of the product carrying device 20. This arrangement creates plenums 190 and 192 above and below the fans, and an air passage 194 of the opposite enclosure 10B. The tray 196 in the carrying device 20 in enclosure 10B, along with the tray 60 in the device 20 in enclosure 10A, causes the flow of air to be as shown in FIG. 12, over the product in one direction below the trays 60 and 196, up through the air passage 194 in enclosure 10B, and across the product 58 in the other direction in the upper region of the carrying devices 20, through the evaporator 100, and into the plenum 190 where the air is circulated through the fan 102 into plenum 192. Thus, the placement of the evaporator relative to the enclosure is such that the air is evenly directed through the evaporator 100 and product carrying devices 20.

FIG. 14 is a cross-sectional view of an embodiment of the freezing system in which the evaporator heat exchanger 102 and fan are placed below the trolleys 20. The evaporator is positioned at a diagonal angle to maximize the space available to the trolleys and frozen product. The trolleys can be supported in the enclosure 10 by any suitable means, such as a frame extending above the base having rollers supporting the trolleys, by an overhead support system for carrying and transporting the trolleys, or otherwise. This configuration can be used where it is beneficial to have the product at a loading dock height. Frozen product can be loaded into refrigerated containers or trailers without changing the elevation of the product. Additionally, the configuration simplifies defrost, as the water can drip onto the floor and drain out through suitable drains in the floor (not shown). All of the features of the embodiment of FIG. 9 discussed above are available with the undermount embodiment of FIG. 14.

Figure 15:
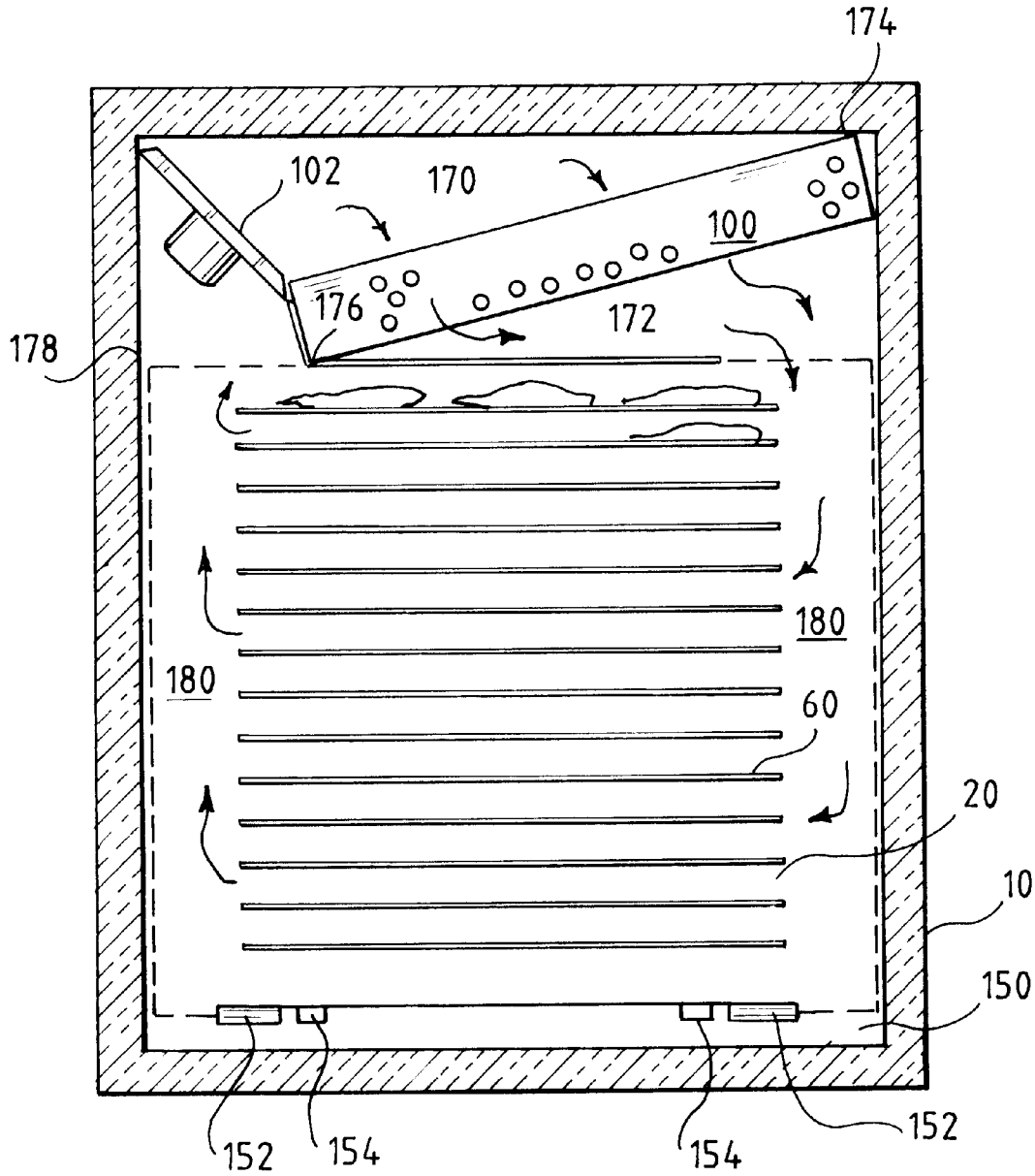
FIG. 15 is a cross-sectional view of an embodiment of the freezing system in which the evaporator heat exchanger is placed above the trolleys.

FIG. 15 is a cross-sectional view of an embodiment of the freezing system in which the evaporator heat exchanger is placed above the trolleys. The floor 150 of the enclosure 10 incorporates rollers 152 for supporting the base of the trolley 20 and a chain drive mechanism 154 that engages the base of the trolley and moves it in a controlled manner from the entrance of the enclosure 10 to the exit of the enclosure. The details on the chain drive mechanism 154 are not particularly important and can be developed in accordance with a variety of known methods. The design detail will depend on the mechanical structure of the base of the trolleys, the dimensions and features of the chain drive mechanism and other details which are within the ability of persons skilled in the art. A preferred system is one in which the chain pushes a trolley an amount equal to the width of a trolley. The chain pushes evenly in the direction of travel. Suitable guide rails or other features (not shown) may be needed to prevent rotational movement of the trolley to prevent binding or jamming of the trolley, and these implementation details are well within the ability of persons skilled in the art.

Figure 16:
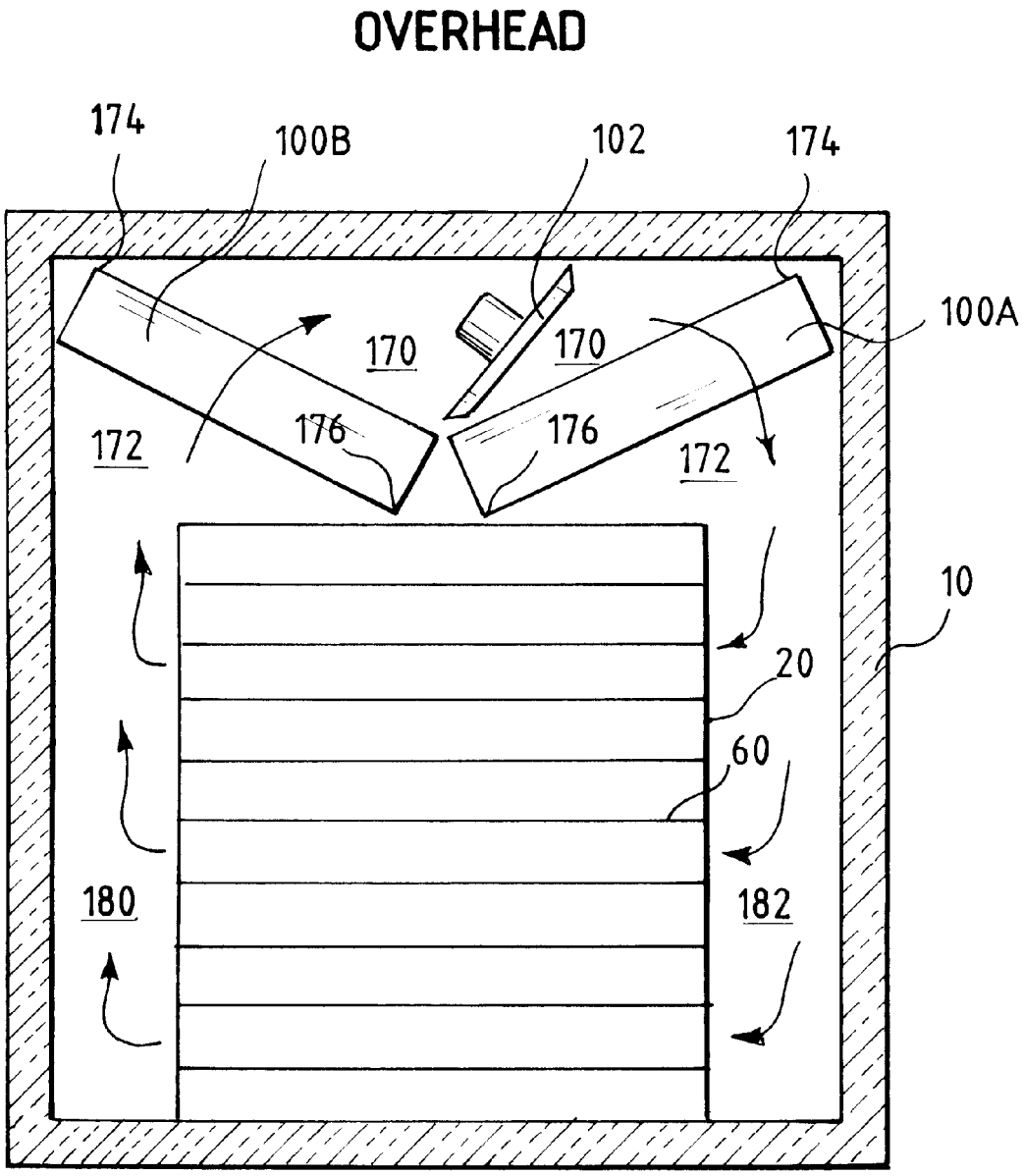
FIG. 16 is an illustration of an alternative arrangement of the evaporator in which dual evaporators are placed at an angle above the trolleys within the container to maximize space available for the trolleys.

FIG. 16 is an illustration of an alternative arrangement of the evaporator in which dual evaporators 100A and 100B are placed at an angle above the trolleys 20 within the container to maximize space available for the trolleys. The embodiment of FIG. 16 provides more heat exchange surface area with less effective face area. This results in an increased temperature drop through the evaporators 100A and 100B for a given refrigerant temperature. This configuration is beneficial where product heat transfer rate to the air is high or where the temperature differential between the air and the refrigerant is low. The evaporators 100A and 100B can be located along a portion of the enclosure 10, or along the full length of the enclosure 10. The trolley design, zone separation, and other features outlined in the embodiment of FIGS. 1 and 9 are also applicable to embodiment of FIG. 16.

FIG. 17 is an illustration of an alternative arrangement of the evaporator like in FIG. 16, in which dual evaporators 100A and 100B are placed at an angle below the trolleys within the container to maximize space available for the trolleys 20. The support for the trolleys 20 within the enclosure 10 can be by any convenient fashion, such as by providing vertical supports and rollers for the trolleys or by an overhead system that supports the trolleys from above. The features of the embodiment of FIGS. 1, 9, 14 and 16 are also applicable to this embodiment.

Refrigeration System and Low Frost Accumulation Evaporator Design

Figure 18:
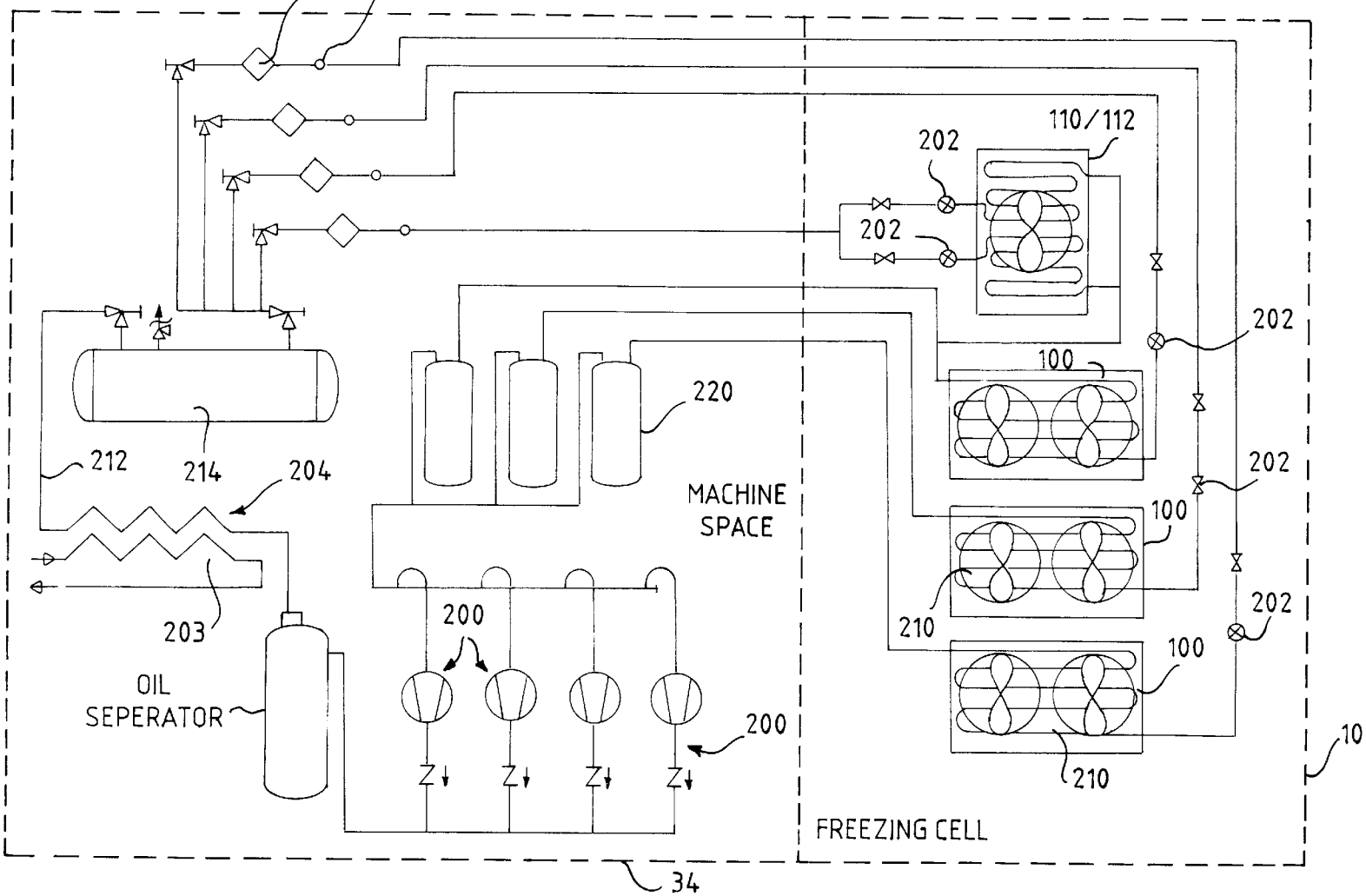
FIG. 18 is a schematic diagram of the freezing system used in the system of FIG. 1.

Referring now to FIG. 18, a representative refrigeration system that can be used with the blast freezer system of any of the above embodiments will now be described. A set of vapor compressors 200 pumps a refrigerant around a closed loop refrigeration circuit, where the vapor compressor(s) 200 and a metering valve(s) 202 divide the refrigeration circuit into two pressure regions, a low pressure region and a high pressure region. The low-pressure area is where heat is absorbed from the product to be cooled. The heat is absorbed by the refrigerant while moving through the evaporator(s) 100 in the blast freezer enclosure 10 at its saturation pressure/temperature (and in the evaporators 110/112 in the entrance vestibule). The refrigerant changes state from a liquid to vapor in the evaporators 100, 110, 112, and in the process removes heat from the air in the insulated enclosure. The heat absorbed from the product to be cooled, together with heat from mechanical work performed, is rejected in the high pressure area by a heat sink 203 as it passes through a condenser 204. The refrigerant changes state from vapor phase to liquid phase at the higher saturation pressure/temperature. When this change of state occurs, the refrigerant gives off heat through the heat exchanger 203 in the condenser 204.

The vapor compressors 200, usually a positive displacement type, removes a specific volume of refrigerant gas from the low pressure area with each revolution reducing the saturation pressure/temperature until a balance is achieved where the volumetric gas supply from evaporation equals the compressor(s) volumetric pumping rate. The metering valve(s) 202 regulates the flow of liquid refrigerant from the high-pressure area into the low-pressure area. The metering valves 202 open when complete evaporation has occurred, thereby assuring the presence of only refrigerant gas at the compressor inlet, preventing mechanical damage. A portion of the warmer liquid refrigerant entering the low-pressure area evaporates very rapidly absorbing heat from the refrigerant itself until both liquid and gas reach equilibrium at the saturation pressure/temperature within the low-pressure area. Refrigerant in both liquid and gas states are moved through the serpentine tubes of the evaporators 100, 110, 112 by a pressure differential between inlet and outlet. The blast freezer of FIGS. 1 and 2 utilizes air-to-refrigerant heat exchanger(s) 100 located within the insulated enclosure 10 or freezing cell to transfer heat from the product to air and in turn from the air to the refrigerant. The evaporators 102 are constructed with fins perpendicular to and in contact with the refrigerant carrying tubes 210, which increases the effective surface area in contact with the air. Air is moved at high velocity between the fins and perpendicular to the tubes by fans 102 (see e.g. FIGS. 12, 15, 16), where heat is transferred through the fins and tubing to the lower temperature refrigerant. The cooled air is then circulated through hanging product or product placed on trays. The spacing of the trays is adjustable thereby enabling adjustment of the air passage cross sectional area between the trays and product, providing the ability to optimize airflow velocity in contact with and over the product. Heat from the product is transferred to the cooler air, the warmed air is then cycled back through the evaporator where the heat removed from the product is transferred to the refrigerant as the air is cooled.

The refrigerant gas, having absorbed sufficient heat from the product to completely change state from a liquid to gas, is moved through piping to the compressors 200 where it is compressed to a saturation pressure/temperature sufficiently higher than the heat sink 203 temperature. The higher pressure gas is then discharged to the heat exchanger 203 in the condenser 204, where the heat removed from the product and the heat from work performed is transferred to a heat sink 203, causing the refrigerant gas to first cool to its saturation pressure/temperature and then to change state from a gas back to a liquid. The liquid refrigerant then moves through piping 212 to the receiver 214 where it accumulates, providing a reserve volume of refrigerant and a liquid seal at the receiver outlet assuring a solid liquid supply back to the metering valves 202. The system also includes filters 216, sight glasses 218, and suction accumulators 220 positioned downstream of the evaporators 100 which supply gas phase refrigerant to the compressors 200.

Primary factors influencing the heat exchange rate are temperature difference, surface area, velocity and conductivity. Heat transfer rates are proportional to the temperature difference between the heat source and the heat sink. Persons skilled in the art will appreciate that the specific design of a refrigeration system for use in the subject continuous blast freezing system is not critical to the invention, provided it is suitable for the refrigeration load and temperature necessary, and wide latitude may be exercised in arriving at a suitable refrigeration system for any given application. The placement of individual components of the refrigeration system relative to the insulated enclosure or shipping container is not particularly important. The configuration and placement of the evaporator is important to maximize productivity (space for product and product conveyance devices) and minimize frost formation. Hence the high capacity to depth configurations and the placement of the evaporator in the enclosure shown in the accompanying Figures will give good results in both regards. As another example, the blast freezer may be used in conjunction with a centrally located refrigeration system that not only supplies refrigerant to one or more blast freezers of the present construction, but also refrigerant to other areas, such as insulated storage rooms, refrigerated product preparation areas, etc.

The evaporator 100 design in all of the embodiments described above has a high capacity to surface area ratio, and such an evaporator, while not essential to the practice of the invention, is a preferred embodiment. The high capacity to depth ratio gives a number of advantages, which will be discussed below. The term "capacity" refers to the overall heat exchange capacity for a given set of conditions. The term "depth" refers to the distance of the fins in the direction of air flow across the evaporator. A high capacity to depth ratio is a relative term. The ratio of the embodiments shown in FIGS. 9 and 12–19 is nevertheless a high one, relatively speaking. This is due to the significant longitudinal extent or length of the evaporator along the length of the enclosure 10 and the width of the evaporator extending substantially across the width of the enclosure (see e.g. FIG. 9), whereas the depth or "thickness" of the evaporator (i.e., the dimension in the direction of air flow) is kept to a minimum, and much less than either the length or width of the evaporator. Any evaporator suitable for a high capacity blast freezer that has a depth (dimension along the length of air flow across the evaporator) of less than 15 inches, and a length and width substantially greater than 15 inches, such as for example 64 inches in width and 5 or more feet in length, is considered to be with in the scope of the term "high capacity to depth ratio".

The freezing tunnel or enclosure design and evaporator configuration within the enclosure provides a higher capacity to depth ratio over what has been previously available in prior art freezers for a given cross-section of the evaporator, while still providing the heat transfer capacity needed for high production freezing. One advantage of a high capacity to depth ratio is that there is less frost accumulation on the evaporator fins. It is well known that the capacity of air to hold water in vapor form decreases as the air cools. As air passes through a blast freezing evaporator it is cooled, and water vapor in the air condenses and is deposited on the evaporator fins in the form of frost. The rate of dehydration from the product and frost formation is proportional to the drop in air temperature as the air passes through the evaporator. Another factor increasing frost accumulation is the temperature difference between the air and the refrigerant. A high temperature difference cools the air immediately proximate to the evaporator heat exchange surface to a proportionally lower temperature than air passing through the center of passage between the fins, which accelerates dehydration and frost accumulation. Frost accumulation in itself accelerates further dehydration and higher frosting rates by impeding and slowing the air velocity through the evaporator, which increases air temperature drop, which in turn promotes further dehydration and frosting in a positive feedback loop. Also, frost insulates the heat exchange surface, which cases less production of refrigerant gas to satisfy the volumetric pumping rate of the compressors, which in turn cases the saturation pressure/temperature within the evaporator tubes to lower to a new balance point, resulting in higher temperature difference between the refrigerant and air, and a higher rate of frost accumulation. Moisture is added to the air in the enclosure by passing over the product to be frozen and from moist air infiltrating the enclosure. The hydration added to the air is given up at the evaporator.

The evaporator design of FIGS. 9 and 12–19 with a high capacity to depth ratio minimizes frost formation in several ways. First, less moisture is removed from the product since there is less of a temperature drop in the air as it moves through the evaporator. For example, an evaporator design such as shown in FIGS. 9 and 12–19 may have only a 3–5 degree temperature drop, with the refrigerant at −50 F., the air exiting the evaporator at −42.5 F. and the air coming in to the evaporator at −38° F. to −39° F. With only a 3½–4½ degree temperature drop and an air temperature over the product at −38° F. to −42.5° F., the air can absorb less moisture from the product than with a larger temperature drop due to the lower moisture carrying capacity of the colder air. Secondly, with the high capacity to depth ratio design and lower temperature drop overall, the differential between the refrigerant and the air is less, resulting in less frost formation. Since these features minimize frost buildup initially, buildup of frost and the consequent positive feedback loop or spiral of increased frost formation is delayed and minimized. The result is that the freezer design is capable of running at maximum efficiency for longer periods of time, which results in shorter or less frequent defrost cycles, and thus a freezing system with a higher productivity characteristics.

In certain situations where frost formation is not expected to be as significant a problem, the fins of the evaporator can be placed closer together to increase the surface area of the evaporator, thereby increasing heat exchange capacity and freeze rates.

Tray Embodiment with Reversing Mechanism

Figure 19:
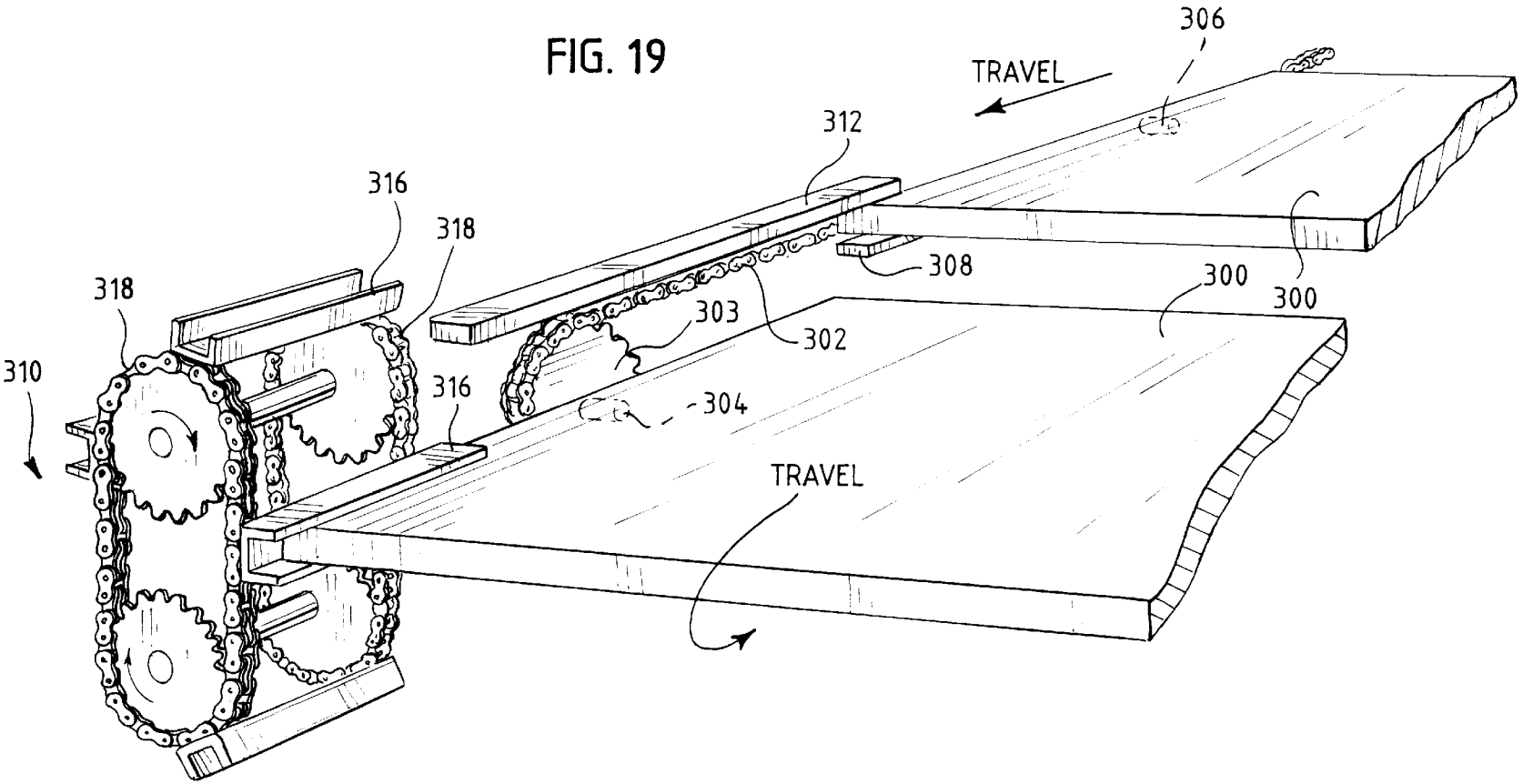
FIG. 19 is a schematic diagram of a mechanism for transferring trays such as contact freezer places and reversing the direction of the trays. The system of FIG. 19 is of general applicability. One example is a transfer mechanism for freezer trays though a freezer.

Referring now to FIG. 19, a method for conveying contact freezer plates or trays 300 on multiple passes through a freezer using a conveyor chain 302 will now be described. The method of FIG. 19 is an alternative to the trolley embodiment of FIGS. 1–4 and is of general applicability to other types of systems. The trays 300 remaining upright as the chain 302 reverses direction. The fore-aft spacing between the trays 300 and the height of the spacing between trays is adjustable. The chain travels over sprockets 303 placed on any suitable support frame or structure parallel to the sidewalls of the enclosure. The sprockets 303 are placed at the ends of the freezer, only one of which is shown. The chain can go back and forth the length of the freezer in multiple levels allowing product to move through the freezer at multiple levels.

Each tray 300 is attached to the conveyor chain 302 at the center of each tray along the sides of the trays. The attachment is by means of an extended chain pin 304 that loosely fits into an aperture 306 in the sides of the trays, in a manner allowing free rotation of the tray on the pin.

As the tray 300 is pulled along through the freezer by the chain attachment pin 304, the tray is prevented from rotating by a support guide 308 or similar structure fastened to the sides of the freezer. The guide 308 also carries the product weight, preventing the chain 302 from sagging. Thus as the tray 300 reverses direction the upper face thereof remains facing upwards.

At each end of the freezer, a direction reversing mechanism 310 is provided for reversing the direction of movement of the trays, such that as the chain 302 moves back to the front of the freezer the tray 300 travels with it. As the tray enters the direction reversing mechanism 310, the bottom guide 308 ends and an upper guide 312 begins, continuing to prevent the tray from rotating. The leading edge of the tray ends 314 slide into a clip 316 on a short dual secondary chain 318. As the tray support pin 304 on the main conveyor chain 302 rotates around the end sprocket 303 the clip 316 on the secondary chain 318 holds the tray 300 level while moving freely up or down in time with, and being driven by, the pin attachment 304/306 to the main conveyor chain 302. Clips 316 are spaced on the dual secondary chain 318 such that a new clip 316' is brought into position for the next tray. As the conveyor chain reverses direction the tray ends are drawn out of the clip 316, the tray being again supported by a guide rail or support structure as it passes back to the front of the freezer. A direction reversing mechanism 310 shown in FIG. 19 is placed at the front of the freezer and transfers the tray to a second level below the level shown in FIG. 19 and the process repeats.

Conventional conveyors dump product onto a lower level and travel back to the other end upside down wasting valuable space. Also, the drop damages delicate product such as whole salmon or other fish. Conventional trays must be narrower in order to make the turn around the end sprocket before returning to the other end.

This improved conveyor allows product trays to pass through a processing area for direct loading, then directly into the freezer, then directly to the off-loading area and back for another cycle. Trays can be of a wide heat exchange design and can also provide a vertical airflow barrier where beneficial. This conveyor design can be used with any freezer configurations and is beneficial for high production applications.

Trolley Conveyor System with Automatic Tray Loading and Unloading

In certain high production installations of the freezing system of FIG. 1, it may be advantageous in terms of labor savings and increase the capacity of the system to automatically insert and remove the trays 60 from the trolleys 20. The design of the trolley of FIG. 5 permits automation of tray loading and loading.

The trolley tray 60 design, in which the trays rest on the support rails 72 as shown in FIGS. 5 and 6, is such that the trays can be automatically inserted and removed out the open end of the trolley frame and raised or lowered to a powered or manual roll or wheel conveyor level. The trays can then be moved end to end or separately through a food processing area at a convenient height to facilitate placement of product to be frozen on the tray thereby eliminating transfer labor. Once loaded, trays continue on the conveyor to an automatic tray-to-trolley insertion station where trolleys are loaded and automatically fed into and through the insulated enclosure. Once frozen, trolley can be conveyed to an automatic unloader station where trays are removed from the trolley. Frozen product can be automatically removed from the trays 60 by passing through or pausing on a slight inclined portion of the conveyor, where vibration applied to the tray could facilitate release and sliding of product onto a packaging or glazing belt. The trolleys and trays could then be rotated through sanitizing station (cleaning) before re-entering the processing and automated tray loader station. This system combines benefits from highly automated freezing plants, conventional trolley system and continuous belt processing and product transport within freezing plants. These benefits can be combined with any of the embodiments of the freezing system described above and are suitable for installation in smaller plants and remote areas.

Figure 20:
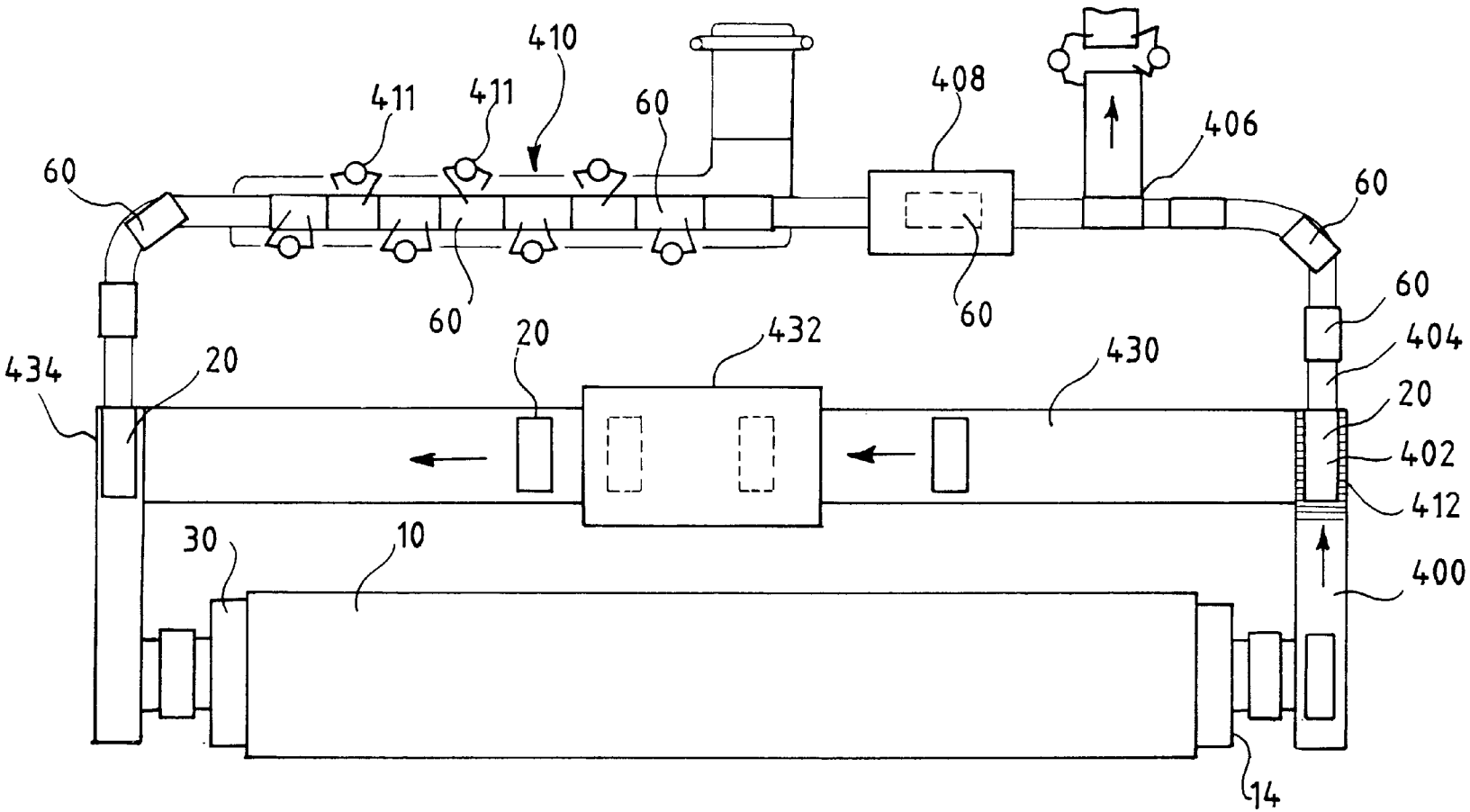
FIG. 20 is a schematic diagram of a continuous production freeing system having stations which automatically unload trays loaded with frozen product from a trolley and automatically load trays loaded with product onto a trolley.

A representative embodiment of a high capacity freezing production line with automatic tray loading and unloading will now be described in conjunctions with FIGS. 20–22. The system of FIG. 20 includes an insulated enclosure 10 having an evaporator therein, an entrance vestibule 30, and trolleys 20 that move through the enclosure 10. The trolleys 20 move through the enclosure 10 at a rate such that by the time they have moved to the exit 14 of the enclosure 10 the product is sufficiently frozen. This particular system could have the rest of the refrigeration system (eg., condensor, pumps, etc.) on top of the enclosure or in a remote location.

Trolleys 20 exiting the enclosure 10 with frozen product are conveyed on a conventional roll conveyor 400 to an automatic tray unloading station 402 described below, where trays 60 loaded with frozen product are removed from the trolley 20. The trays 60 are transferred to a second conveyor 404 that conveys trays 60 to an unloading station 406 where product is removed from the trays and boxed, sent to a glazing station, or other appropriate action is taken with the product. The trays 60 are conveyed to a washing station 408 (if desired) and a loading station 410. Workers 411 load the trays 60 with product supplied to the workers 411 through any suitable and conventional means.

Figure 22:
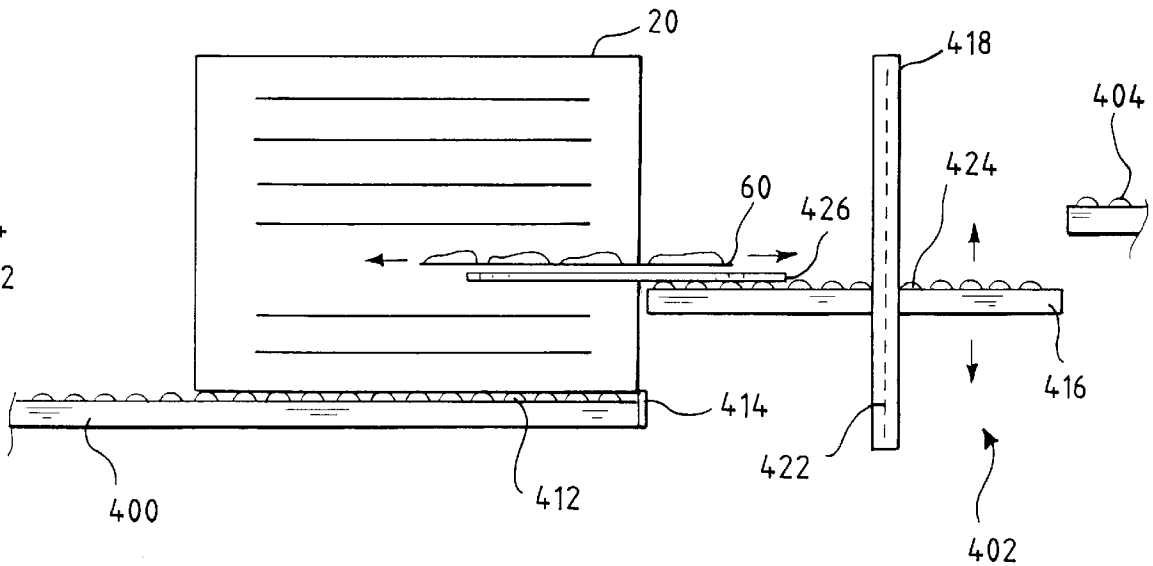
FIG. 22 is a side view of the automated tray unloading station of FIGS. 20 and 21.

After exiting from the enclosure 10, the trolley 20 is first indexed in relation to the unloader station or mechanism 402 by slightly skewed rollers 412, causing the trolley 20 to bear against one roller guide rail (not shown) prior to being stopped at an accurate and known location in the station 402 by a limit switch (not shown) and a stop block 414 (FIG. 22).

Figure 21:
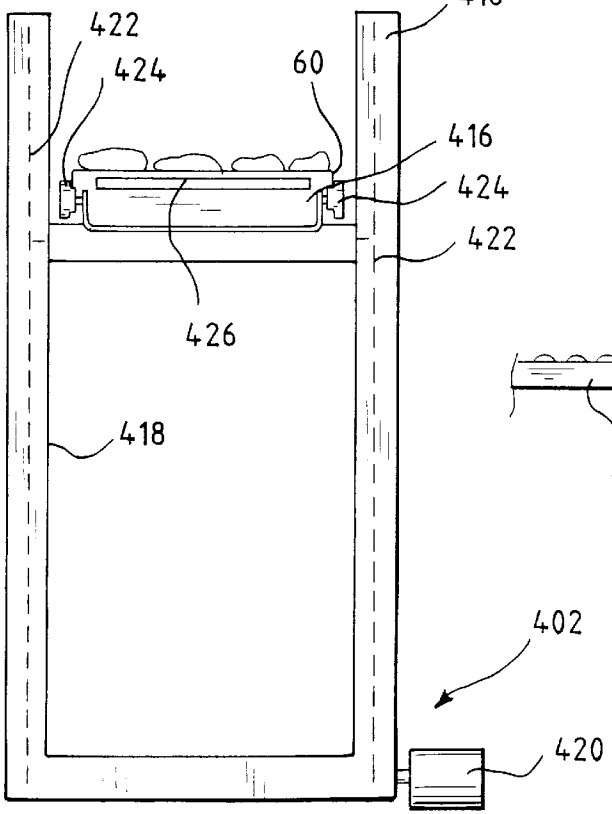
FIG. 21 is an end view of the automated tray unloading station of FIG. 20.

With reference to FIGS. 21 and 22, one possible unloading mechanism 402 consists of a transfer conveyor 416, approximately the same length as the trolley 20, that is raised and lowered into positions in alignment with the trays 60 as placed in the trolley during loading and freezing (which may vary, of course). The unloading mechanism 402 is also positioned in alignment with the second conveyor 404. The transfer conveyor 416 is supported with a guide rail 418 on each side that holds the transfer conveyor section rigid horizontally, while allowing free vertical movement. Raising and lowering of the transfer conveyor is accomplished by a conventional servo motor 420, which drives a chain 422 attached to and supporting the transfer conveyor 416. The chain is formed as a part of the side guide rails 418. Position indexing and motion of the transfer conveyor 416 are controlled by conventional optical position sensors and sequencing controllers (not shown). The transfer conveyor 416 has a row of wheels 424, some of which are powered, on each side that are spaced to accept and guide the trays 60 as they are transferred to the second conveyor 404. A thin platform 426 is positioned between the transfer conveyor wheels 424. After the transfer conveyor has been positioned at the proper vertical height to extract a tray (using the optical sensor), the platform 426 is extended out under the tray 60 within the trolley, raised slightly to transfer the weight of the tray 60 to the platform 426 and lift the tray off the support rails 72 (FIG. 5), and then retracted to extract the tray 60 from the trolley 20. When the platform 426 has been fully retracted, the platform 426 is lowered slightly to transfer the weight of the tray onto the transfer conveyor wheels 424. After positioning to an alignment condition relative to the second conveyor 404, the powered wheels 424 are operated to move the tray 60 onto the second conveyor 404. This process is repeated until all of the trays 60 have been removed from the trolley and transferred to the second conveyor 404.

With the extendible platform then resting in its retracted position, the trolley is conveyed approximately perpendicular onto a trolley transfer conveyor 430 (FIG. 20) to an optional washing station 432 and to a trolley tray loading station 434. The trays loaded with product are loaded automatically into the trolleys 20 at the trolley tray loading station 434. The trolley tray loading station includes a second transfer mechanism 436 which is essentially identical to the trolley tray unloading mechanism just discussed. The second transfer mechanism 436 operates in accordance with the principles of the unloading mechanism, but in reverse. The loaded trolleys 20 are conveyed to the entrance vestibule 30 and into the insulated enclosure 10 and back to the unloading station 402, and the process repeats itself.

It is also possible, with suitable conveyor routing and timing, to use only one tray transfer mechanism such as shown in FIGS. 21 and 22 for both tray loading and tray unloading.

An alternative mechanism for loading and unloading trays from the trolleys is to provide features on the edges of the tray, such as handles, flanges, or other mechanical structures such as shown in FIGS. 23 and 25, which are grasped or otherwise engaged by an arm or other suitable mechanism that reciprocates back and forth relative to the trolleys. The arm would engage the handle or other feature, and pull the tray completely out onto a any suitable transfer conveyor. This embodiment would be beneficial particularly where the trays is loaded with product that nearly touches the tray above it, and no lifting of the tray is required.

Figure 28:
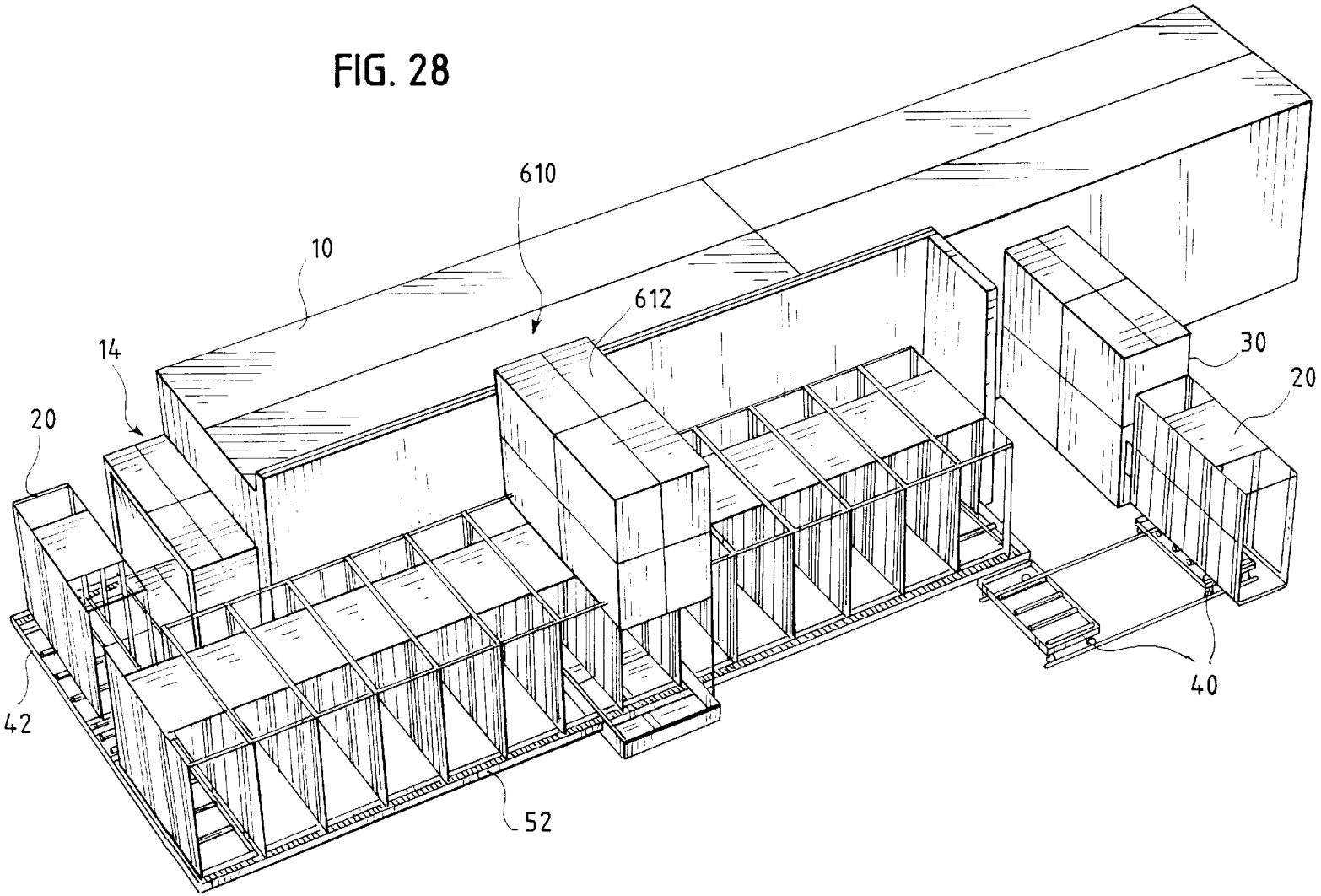
FIG. 28 is a perspective view of a self-contained continuous throughput blast freezing system including roller aprons, entrance vestibule, exit vestibule, and trolley wash station.

Another example of an entire system is shown in FIG. 28. The container includes an entrance vestibule 30, exit 14, exit roller apron 42, side roller apron 52, and entrance roller apron 40. As the trolleys 20 exit the enclosure 10, they are moved on the exit roller apron 42 to the side roller apron 52. Product is slid off the trays of the trolley and boxed for shipment. The trolleys proceed to a wash station 610, comprising an enclosure 612 and reciprocates up and down and envelopes the trolley 20 when in its lower position. The interior of the wash enclosure 612 contains spray nozzles that wash the trolleys with water. The wash enclosure 612 moves to the upper position and the trolleys index forward. Product is then loaded onto the trolleys and they are advanced to the entrance apron 40 and placed into the entrance vestibule 30.

A representative example of the environment where the freezing system of FIGS. 1–4 may be employed is a typical 65 foot to 75 foot purse seine fishing boat. The advantages of the illustrated self-contained continuous throughput blast freezer over current systems will be appreciated when one considers the type of refrigeration systems typically currently used on such boats, the drawbacks of such systems, and how the present freezer system overcomes these drawbacks. These advantages will be apparent from the following discussion.

The typical fish boat in this size has 4 holds, 2 on each side of a 2 ft. wide, under deck walkway running from the engine room to the stem. Currently, such vessels have existing freezing systems which utilize stationary plates in the two aft holds where batch loads of 200 boxes of fish are frozen requiring about 9–10 hours time on the plates to complete the process. The product is then transferred to the forward holds where temperature is maintained at −30° F. by a separate holding refrigeration system, thereby making way for a new batch on the plate freezer. The existing process requires 9 people and two boats to freeze the desired 1000 boxes or 15,000 Lb. per day. Additionally, 3 freezer cycles take 27 to 30 hours, which progressively advances sleep, or rest time to a different time each day. This in turn continually staggers the rest pattern for the workers.

The problem with the existing system is the effort required to stage large batches in the staging area on deck then jumping down in the hold, unloading, transferring and stacking frozen product, then passing boxes down from deck and reloading the freezer plates all done at −30° F., often on hands and knees. Another problem is that these vessels, by virtue of economic reality, are required to be combination vessels. For other fisheries the holds are often filled with water, fish, or both, requiring freezing equipment to either be removable or impervious to damage from this source. At the very least, any permanently mounted equipment would take up potentially valuable revenue producing space.

The system described herein can be configured as a self contained, deck mounted single blast freezer cell that uses a continuous throughput process. It thus has a much higher capacity, and uses less labor, than the existing system. Only 3–4 people would be needed to load, unload, transfer and stack 15,000 Lb. in just 16 hrs. on a single boat. The exit of the insulated enclosure can be placed over the holding area and cold air from the fast freezer cell can be conducted to the hold and provide the refrigeration needed to maintain −30° F. in the vessel's storage area. The trolleys can be used as a dumb waiter to move frozen product down to the storage area. The freezing system, including mechanical equipment, can be built into a single 14 foot transportable container whose cross-sectional dimension is the same as a standard shipping container. As such, the unit can be completely removed and rented or leased to another boat or fishing company and thereby provide a source of revenue. The vessel's hold is not violated and can be used for wet purposes without interference from refrigeration equipment.

It is apparent that there are numerous other possible applications for the subject freeing system and it is ideal for all manner of applications. As an example, a 40 foot standard shipping container sized unit could be easily transported anywhere in the world and would be capable of freezing 75,000 to 85,000 lbs. of product per day. The trolley and tray configuration could be varied to accommodate a wide variety of product thickness and irregular products. In addition, the trays could be designed to improve heat exchange providing the benefit of direct single contact plates, as indicated at 76 in FIG. 6.

Complete freezer systems can be completed and tested at the factory for shipment anywhere. All that would be required on site would be the power to operate the system. As an example, with this technology it would be much simpler and less expensive than conventional methods to set up a high capacity freeze plant to take advantage of the under utilized salmon runs on the east coast of Russia. A single 40 foot container sized fast freeze system such as shown in FIG. 1 could fill two 40 foot standard refrigerated shipping containers within 24 hours. When the season is completed, the fast freezer cell could be easily moved to a new location for another application.

Another application would be onboard a catcher processor or processor vessel where the fast freeze system would be located on deck for freezing purposes only, or over the hold for freezing while doubling as the refrigeration plant for the storage area.

The inventive freezing system described above completely replaces the refrigeration system used in the representative purse seine fishing vessel. The advantages of the freezing system described above are many. The system provides a method and apparatus for quick freezing a wide variety of foodstuffs producing high quality frozen products in single freezing apparatus. The freezing system can be loaded onto the deck of the fishboat and used for the fishing season, then off-loaded and transported to another vessel or location for use.

Another advantage is that it provides a freezing system that requires relatively fewer units of space per units of freezing capacity. The design of the trolleys and refrigeration heat exchanger within the insulated enclosure is such that space for comestibles is maximized, increasing the productivity of the system.

Another advantage of the illustrated embodiments is that it provides a freezing system that can easily be contained in an enclosure such as a standard shipping container. The mechanical refrigeration apparatus (condenser, compressor and other parts) can be built in the shipping container itself, in a separate shipping container, or assembled separately.

A particular advantage of the trolley design is that it provides a complete freezing and product handling system where plate trays or mesh shelves are fully adjustable in product gap allowing the control of air velocity over the product during freezing. Thus, the air flow across the comestibles can be equalized over all the trays, regardless of their position in the trolley. This promotes more even freezing of the product. Furthermore, the trays or mesh shelves can be automatically loaded and unloaded onto the trolleys. This enables continuous rotation through unloading, cleaning, drying and product loading. In this embodiment, the product preparation area is designed such that the product can be loaded conveniently on to the trays directly from preparation, then the trays are automatically reloaded onto adjustable racks for another cycle.

The system is also able to accommodate zones of differing temperature and/or air flow directions. These separation zones improve the ability of the freezing system to provide a steady and continuous source of refrigeration for an adjacent storage space. For example, as the product moves through the insulated enclosure, the amount of heat withdrawn from the product progressively diminishes. The temperature zone nearest the exit of the enclosure may provide a source of refrigeration for an adjacent storage space, such as the hold of a vessel.

The illustrated embodiments are highly suited to installation on board fishing vessels. The output or exit end of the insulated enclosure can be placed over the hold of a ship providing refrigeration for the hold and eliminating the need for an additional refrigeration system. The product trolleys can act as dumbwaiters and be used with a product elevator system for moving product up, down or sideways into the vessels adjacent holding space thereby eliminating manual labor. When the product is unloaded from the trolleys, the trolleys are moved back to the preparation area for loading with new product and another cycle of refrigeration. Since the trolleys are removable from the blast freezer, they can be separately cleaned without shutting down the production line.

Various modifications to the illustrated embodiments may be made without departure from the spirit and scope of the invention. This true scope and spirit is to be arrived at by reference to the appended claims, interpreted in light of the foregoing specification.

What is claimed is:

1. A freezing system for continuous production of frozen comestibles, comprising:

an insulated enclosure having an entrance for receiving comestibles to be frozen and an exit for delivering frozen comestibles;

a refrigeration system cooling said enclosure to thereby freeze said comestibles; and a plurality of trolleys moveable within said enclosure between said entrance and said exit, said trolleys for holding comestibles to be frozen; said trolleys containing adjustment features enabling the placement of said comestibles in said trolleys to be changed depending on the size of said comestibles and a substantially solid panel on at least one side of said trolley extending transverse to the direction of movement of said trolleys through said enclosure substantially blocking the flow of air in the direction of travel of said trolleys through said enclosure; wherein a continual introduction of said trolleys into said entrance with comestibles to be frozen, the movement of said trolleys within said enclosure between said entrance and said exit, and a continual removal of said trolleys from said enclosure at said exit, provide a continual production of frozen comestibles by said freezing system.

2. The system of claim 1, wherein said insulated enclosure comprises a container sized and adapted to be transported from one place to another.

3. The system of claim 2, wherein said refrigeration system includes a condenser and a compressor and wherein said condenser and compressor are housed within said container.

4. The system of claim 1, wherein said enclosure comprises a plurality of rollers extending from said exit to said entrance and providing an apron for sliding said trolleys from said exit to said entrance.

5. The system of claim 1, wherein said trolleys are adapted to receive a plurality of product trays and wherein said trolleys further comprises an plurality of vertically disposed adjustment features allowing said product trays to be placed within said trolleys at a variety of different heights.

6. The system of claim 5, wherein said tray further comprises heat dissipation fins or other suitable features designed to conduct heat from said tray into air surrounding said tray.

7. The system of claim 1, wherein said trolleys comprise one or more features are adapted to hang comestibles within said trolleys.

8. The system of claim 1, further comprising an entrance vestibule exterior of said container, said entrance vestibule comprising an enclosure for receiving a least one of said trolleys and at least one evaporator, said entrance vestibule chilling said trolley and comestibles loaded thereon and removing moisture from air surrounding said comestibles and moisture from said comestibles prior to movement of said trolley into said insulated enclosure thereby reducing the formation of frost in said insulated enclosure.

9. The system of claim 8, wherein said at least one evaporator comprises a pair of evaporators separately subject to defrost cycles such that when one of said evaporates is subject to a defrost cycle the remaining evaporator is functional.

10. The system of claim 9, wherein said pair of evaporators are separated by a insulation barrier.

11. The system of claim 1, wherein said refrigeration system comprises an evaporator arranged in the interior of said enclosure having a high surface area to depth ratio in which said evaporator has a width and a length to define a face area of said evaporator and a depth, and wherein said width and length are substantially greater than the depth of said evaporator.

12. The system of claim 11, wherein said enclosure comprises a modified shipping container.

13. A freezing system for continuous production of frozen comestibles, comprising:

an insulated enclosure having an entrance for receiving comestibles to be frozen and an exit for delivering frozen comestibles;

a refrigeration system cooling said enclosure to thereby freeze said comestibles; and a plurality of trolleys moveable within said enclosure between said entrance and said exit, said trolleys for holding comestibles to be frozen; said trolleys containing adjustment features enabling the placement of said comestibles in said trolleys to be changed depending on the size of said comestibles wherein said insulated enclosure comprises a container sized and adapted to be transported from one place to another; and wherein said refrigeration system comprises an evaporator placed within said container and a plurality of fans arranged to blow air over said evaporator and through said trolleys in a direction substantially orthogonal to the direction of movement of said trolleys through said container.

14. The system of claim 13, wherein said evaporator is placed above said trolleys within said container.

15. The system of claim 13, wherein each of said trolleys comprises a front side and an opposite rear side, said front and rear sides sized so as to extend width-wise across the interior of said container perpendicular to the direction of travel of said trolley within said container, and wherein at least one of said front side and said rear side comprises a substantially solid panel substantially blocking the flow of air in the direction of travel of said trolley within said container.

16. A freezing system for continuous production of frozen comestibles, comprising:

an insulated enclosure having an entrance for receiving comestibles to be frozen and an exit for delivering frozen comestibles;

a refrigeration system cooling said enclosure to thereby freeze said comestibles; and a plurality of trolleys moveable within said enclosure between said entrance and said exit, said trolleys for holding comestibles to be frozen; said trolleys containing adjustment features enabling the placement of said comestibles in said trolleys to be changed depending on the size of said comestibles; wherein said refrigeration system includes a condenser and a compressor and wherein said condenser and compressor are housed within a second enclosure, and wherein said second enclosure and said insulated enclosure comprise containers adapted to be transported by ship, rail and/or truck.

17. A freezing system for continuous production of frozen comestibles, comprising:

an insulated enclosure having an entrance for receiving comestibles to be frozen and an exit for delivering frozen comestibles;

a refrigeration system cooling said enclosure to thereby freeze said comestibles; and a plurality of trolleys moveable within said enclosure between said entrance and said exit, said trolleys for holding comestibles to be frozen; said trolleys containing adjustment features enabling the placement of said comestibles in said trolleys to be changed depending on the size of said comestibles, said trolleys having a substantially solid panel on at least one side of said trolley extending transverse to the direction of movement of said trolleys through said enclosure substantially blocking the flow of air in the direction of travel of said trolleys through said enclosure; wherein said enclosure comprises a drive mechanism for transporting said trolleys from one place to another within said insulated enclosure, wherein the drive mechanism is adjustable to vary the rate of transport of said trolleys.

18. A mobile, self-contained freezing system for continuous production of frozen comestibles, comprising:

an insulated enclosure having an entrance for receiving comestibles to be frozen and an exit for delivering frozen comestibles; said insulated enclosure sized and adapted to be transported from one place to another and defining a longitudinal axis;

a heat exchanger in said enclosure;

a plurality of fans arranged to blow air through said heat exchanger in an manner transverse or oblique to the longitudinal axis of said enclosure; and a plurality of trolleys moveable within said enclosure between said entrance and said exit, said trolleys comprising features for holding comestibles to be frozen; said trolleys containing adjustment features enabling the placement of said comestibles in said trolleys to be changed depending on the size of said comestibles; wherein a continual introduction of said trolleys into said entrance with comestibles to be frozen, the movement of said trolleys within said enclosure between said entrance and said exit, and a continual removal of trolleys from said enclosure at said exit, provide a continual production of frozen comestibles by said freezing system.

19. The system of claim 18, wherein said trolleys comprise a substantially solid panel on one side thereof such that when said trolleys are moved within said container said panel is oriented width-wise within said enclosure such that the longitudinal flow of air through said enclosure is substantially reduced.

20. The system of claim 19, wherein said refrigeration system comprises an evaporator placed within said container and a plurality of fans arranged to blow air over said evaporator and through said racks in a direction substantially orthogonal to the direction of movement of said trolleys through said container.

21. The system of claim 18, wherein said evaporator is placed above said trolleys.

22. The system of claim 18, wherein said evaporator is placed below said trolleys.

23. The system of claim 18, further comprising an entrance vestibule comprising a substantially air-tight, insulated enclosure having a source of cold air to thereby pre-chill a trolley loaded with comestibles prior to movement of said trolley into said insulated enclosure and reduce the formation of frost within said enclosure.

24. The system of claim 18, wherein said refrigeration system comprises an evaporator arranged diagonally above said trolleys within said enclosure.

25. The system of claim 1 or claim 18, wherein said insulated enclosure further comprises at least one freeze zone separation baffle extending widthwise within said enclosure from the walls of said enclosure to the sides of said trolleys to thereby help reduce longitudinal flow of air within said enclosure.

26. The system of claim 1 or claim 18, wherein said trolleys carry a plurality of horizontally disposed trays supporting said comestibles, and wherein trolleys comprise a plurality of vertical adjustment positions for said trays such that said trays may be spaced relative to each other so as to equalize the flow of horizontally air across said trays as said trolleys are moved through said insulated enclosure.

27. A freezing system for continuous production of frozen comestibles, comprising:

an insulated enclosure having an entrance for receiving comestibles to be frozen and an exit for delivering frozen comestibles, said insulated enclosure defining a longitudinal axis;

a heat exchanger placed in and extending in a longitudinal direction in said insulated enclosure so as to form a freezing cell having two compartments for moving comestibles through said enclosure, one compartment on each side of said heat exchanger, said compartments extending along the longitudinal axis of the enclosure;

a plurality of fans arranged to blow air in a manner transverse to the longitudinal axis of said enclosure; and a plurality of devices for holding comestibles to be frozen and moveable relative to said enclosure through said compartments.

28. The system of claim 27, wherein said device comprises a set of trolleys containing adjustment features enabling the placement of said comestibles in said trolleys to be changed depending on the size of said comestibles, wherein said trolleys comprise a solid panel on one side thereof such that when said trolleys are moved within said insulated enclosure said panel is oriented width-wise within said enclosures such that the longitudinal flow of air through said enclosure is substantially reduced.

29. The system of claim 27, wherein said enclosure comprises at least one container sized and adapted to be transported from one place to another.

30. A freezing system comprising first and second elongate insulated enclosures separated from each other by an evaporator, a fan blowing air through said evaporator to thereby provide a flow of cold air to said enclosures, and devices for carrying product moveable through said insulated enclosure.

31. The freezing system of claim 30, wherein said fan is oriented transverse to the longitudinal axis of said enclosures.

32. The freezing system of claim 31, wherein said devices comprise trolleys having a solid panel extending widthwise across said trolleys in a manner perpendicular to the direction of travel of said trolleys through said enclosures.

33. The freezing system of claim 31, wherein said devices comprise trolleys having a means for carrying product to be frozen and adjustment features for adjusting the location of said means for carrying product.

34. The freezing system of claim 30, wherein said first and second insulated enclosures comprises a modified shipping container adapted to be moved from one place to another.

35. A trolley for holding comestibles to be frozen by a freezing system, comprising:

a base, a plurality of support rails, structures extending above said base adapted to receive said plurality of support rails, said support rails for receiving either trays or bars for hooks holding product to be frozen, said structures having a plurality of closely spaced adjustment features for said support rails so as to enable said support rails to be placed at a multitude of different vertical positions in said trolley.

36. The trolley of claim 35, wherein said rails comprise an elongate member having a cross-section adapted to slidingly receive said tray or said bar.

37. The trolley of claim 35, further comprising a solid panel formed on at least one side of said trolley.

38. The trolley of claim 35, wherein said trolley receives at least one tray, and wherein the trolley further comprises a low friction material applied to at least one of said tray or said tray support rail enhancing the ability of said tray to be slid relative to said tray support rail.

39. The trolley of claim 35, wherein said trolley receives at least one tray, and wherein said tray and tray support rail comprise structures cooperating with each other to prevent substantial rotation of said tray relative to said tray support rail during sliding of said tray out of said trolley thereby easing the loading and unloading of said trays from said trolley.

40. A freezing system comprising:

an elongate insulated enclosure defining a longitudinal axis and having an entrance, a heat exchanger comprising an evaporator positioned along one side of said enclosure and extending along the length of the insulated enclosure; and one or more fans blowing air in said insulated enclosure through said evaporator in a manner substantially transverse to the longitudinal axis of said enclosure; and an entrance vestibule exterior of said enclosure and proximate to said entrance, said entrance vestibule comprising an enclosure for receiving a product carrying device and at least one evaporator, said entrance vestibule chilling said product carrying device and comestibles loaded thereon and removing moisture from air surrounding said comestibles and moisture from said comestibles prior to movement of said product carrying device into said insulated enclosure thereby reducing the formation of frost in said insulated enclosure.

41. The freezing system of claim 40, wherein said evaporator is placed above said product carrying devices adjacent a top of said enclosure.

42. The freezing system of claim 40, wherein said evaporator is placed below said product carrying devices.

43. The freezing system of claim 40, wherein one wall of said insulated enclosure comprises said evaporator.

44. The freezing system of claim 40, wherein said product carrying devices comprise product carrying trolleys.

45. The freezing system of claim 40, wherein said product carrying devices comprise a set of trays attached to a mechanism moving said trays through said enclosure.

46. A freezing system comprising an insulated enclosure, a plurality of trolleys carrying product to be frozen on at least one tray through said enclosure, and at least one station provided with a mechanism for either automatically removing said tray from said trolley after said trolley has moved from said enclosure and/or automatically loading a tray loaded with product to be frozen onto said trolley.

47. The system of claim 46, wherein said at least one station comprises a platform moveable vertically relative to said trolley and extendible in a horizontal direction relative to said trolley to lift one of said trays from said trolley or place one of said trays onto said trolley.

48. A mechanism for moving a tray through an enclosure having pairs of opposite support frames, said trays extending between said opposite support frames, comprising:

a pair of main conveyor chains extending along the length of said frames;

a tray support pin extending from each of said chains and engaging said tray at opposite sides thereof; and a direction reversing mechanism for each of said chains for reversing the direction of movement of the trays while the upper side of said trays remains upright, comprising an end sprocket, a guide placed on at least one of said support frames preventing said trays from rotating as said chain reverses direction on said sprocket, and a secondary chain having a clips engaging with the side of said tray, wherein as the tray support pin rotates around the end sprocket said clip engages and holds the tray level while moving freely up or down in time with, and being driven by, the attachment of said tray to said main conveyor chain via said tray support pin.

49. A blast freezer, comprising:

an insulated enclosure defining a longitudinal axis;

an evaporator having a longitudinal extent arranged generally in the direction of said longitudinal axis of said insulated enclosure adjacent to a wall of said insulated enclosure;

said evaporator diagonally oriented with respect to said enclosure and adjacent to one wall of said enclosure so as to maximize the capacity of said freezer for freezing product.

50. The freezer of claim 49, wherein said evaporator is positioned relative to said wall such that air is prevented from flowing over a first longitudinal edge of said evaporator; said diagonal orientation of said evaporator relative to said enclosure thereby defining air plenums on opposite sides of said evaporator through which air may flow;

said evaporator having a second longitudinal edge on an opposing side of said evaporator from said first longitudinal edge, said second longitudinal edge spaced away from said first wall and a second wall of said enclosure; and a fan positioned in said enclosure to direct the flow of air transverse to the longitudinal axis of said enclosure through said evaporator.

51. The freezer of claim 50, wherein said fan is placed between said evaporator and a corner of said enclosure defined by the intersection of said first and second walls.

52. The freezer of claim 50, wherein said freezer further comprises a product carrying device moveable through said enclosure and wherein said second longitudinal edge is placed closely adjacent to said product carrying device.

53. The freezer of claim 49, wherein said evaporator comprises a high surface area to depth ratio in which said evaporator has a width and a length to define a face area of said evaporator and a depth, and wherein said width and length are substantially greater than the depth of said evaporator.

54. The freezer of claim 49, wherein said evaporator comprises a pair of evaporators arranged in said enclosure such that they have a V configuration.

55. The freezer of claim 49, further comprising a product carrying trolley moveable within said enclosure.

56. The freezer of claim 55, wherein said trolleys are constructed an arranged so as to define spaces on opposite transverse sides thereof to thereby allow the passage of air on opposite sides of said trolley.

57. The system of claim 49, wherein said refrigeration system comprises an air-cooled condenser and an evaporator receiving a refrigerant from said condenser, said condenser placed at the exterior of said enclosure and said evaporator placed in the interior of said enclosure, and wherein said insulated enclosure comprises a shipping container modified to function as a freezer cell.

58. The freezer of claim 49, wherein said insulated enclosure comprises a modified shipping container.

59. The freezing system of claim 49, wherein said insulated enclosure comprises a shipping container adapted to be moved from one place to another.

60. A trolley for a freezing system comprising:

a plurality of trays adapted for holding product to be frozen;

a frame structure for receiving said plurality of trays; and said frame structure comprising tray receiving features enabling said trays to be received in said trolleys in a multitude of vertical positions and thereby adjust the spacing of said trays from one another to thereby accommodate different sizes of product and maximize the carrying capacity of the trolley.

61. The trolley of claim 60, wherein said frame structure slideably receives said trays and wherein at least one of said trays and said frame structure further comprises a low friction material enhancing the ability of said tray to slide relative to said frame structure.

62. The trolley of claim 60, wherein said frame structure defines a rectangular base and four sides, and wherein at least one of said sides is enclosed by a substantially solid panel.

63. The trolley of claim 60, wherein said trays and frame structure comprises features mutually cooperating with each other to permit said tray to be substantially slid out of said trolley so that product can be unloaded from said tray without substantial rotation of said tray relative to said frame structure wherein loading and unloading of said tray may be improved.

64. A trolley for a freezing system comprising:

a plurality of trays adapted for holding product to be frozen;

a frame structure for receiving said plurality of trays; and wherein said trays and frame structure comprises features mutually cooperating with each other to permit said tray to be substantially slid out of said frame structure so that product can be unloaded from said tray without substantial rotation of said tray relative to said frame structure wherein loading and unloading of said tray may be improved.

65. The trolley of claim 64, wherein said frame structure defines a rectangular base and four sides, and wherein at least one of said sides is enclosed by a substantially solid panel.

66. The trolley of claim 64, wherein said frame structure slideably receives said trays and wherein at least one of said trays and said frame structure further comprises a low friction material enhancing the ability of said tray to slide relative to said frame structure.

67. A self-contained, continuous throughput blast freezer system comprising:

an enclosure defining a longitudinal axis;

a self contained refrigeration system contained within said enclosure, comprising (1) an evaporator placed within said enclosure and said extending substantially along the length of said enclosure; (2) an air-cooled condenser provided on the periphery of said enclosure; and (3) refrigeration equipment circulating a refrigerant through said condenser and evaporator, and product carrying devices for carrying product through said enclosure.

68. The system of claim 67, wherein said enclosure comprises a modified shipping container and wherein said air-cooled condensers are positioned on the exterior of said modified shipping container within the envelope of dimensions of a standard shipping container thereby facilitating transportation of said system by rail, truck and/or ship.

69. The system of claim 67, wherein said evaporator has a high surface area to depth ratio in which said evaporator has a width and a length to define a face area of said evaporator and a depth, and wherein said width and length are substantially greater than the depth of said evaporator.

70. A continuous throughput blast freezer system comprising:

an insulated enclosure defining a longitudinal axis and having an entrance and an exit;

an evaporator placed within said enclosure and said extending substantially along the length of said enclosure;

product carrying trolleys carrying product through said enclosure, said trolleys including one or more trays;

an unloading station unloading trays from said trolleys after said trolleys have exited from said enclosure;

a tray conveying system carrying trays to product unloading and product loading stations;

a trolley conveying system separately transporting trolleys from said station unloading trays to said entrance; and a loading station loading trays loaded with product into said trolleys; wherein a continual introduction of said trolleys into said entrance with product to be frozen, the movement of said trolleys within said enclosure between said entrance and said exit, and a continual removal of said trolleys from said enclosure at said exit, provide a continual production of frozen product by said freezing system.

71. The system of claim 70, wherein said trolley conveying system comprises set of roller aprons extending from said exit to said entrance.

72. A blast freezer system comprising:

an insulated enclosure having an entrance and an exit;

a means for cooling said enclosure;

product carrying trolleys carrying product through said enclosure from said entrance to said exit, said trolleys including one or more trays;

one or more stations for unloading trays from said trolleys after said trolleys have exited from said enclosure and for loading trays loaded with product into said trolleys.

73. The freezing system of claim 72, further comprising a set of roller aprons extending from said exit to said entrance.

* * * * *